US010113323B2

(12) United States Patent
Lutes

(10) Patent No.: US 10,113,323 B2
(45) Date of Patent: Oct. 30, 2018

(54) CONCRETE FORMING STAKE APPARATUS

(71) Applicant: Stego Industries, LLC, San Clemente, CA (US)

(72) Inventor: James Steven Lutes, Sacramento, CA (US)

(73) Assignee: Stego Industries, LLC, San Clemente, CA (US)

( * ) Notice: Subject to any disclaimer, the term of this patent is extended or adjusted under 35 U.S.C. 154(b) by 19 days.

(21) Appl. No.: 15/339,777

(22) Filed: Oct. 31, 2016

(65) Prior Publication Data

US 2018/0119437 A1 May 3, 2018

(51) Int. Cl.
*E04G 17/14* (2006.01)
*E04G 25/04* (2006.01)

(52) U.S. Cl.
CPC ..... *E04G 17/14* (2013.01); *E04G 25/04* (2013.01)

(58) Field of Classification Search
CPC ..... E04G 17/14; E04G 25/04; E21D 15/02
See application file for complete search history.

(56) References Cited

U.S. PATENT DOCUMENTS 1,329,177 A * 1/1920 Heltzel ..... B28B 7/0017 249/189
1,683,247 A 9/1928 Grothe
1,776,439 A * 9/1930 Kinninger ..... E04G 25/06 248/354.5
1,802,373 A * 4/1931 Byers ..... E21B 1/02 248/354.3
2,164,609 A * 7/1939 Cusick ..... B44C 7/027 126/271.1
2,224,273 A 12/1940 Neptune
2,541,793 A 2/1951 Thompson
2,741,821 A * 4/1956 Findley ..... E04G 17/14 248/354.3
3,195,852 A * 7/1965 Lundell ..... E04G 13/00 249/34
3,208,707 A * 9/1965 Blumrich ..... B64C 25/32 244/108
3,284,973 A 11/1966 Ames
3,579,938 A 5/1971 Hanson
3,681,484 A 8/1972 McKie et al.
(Continued)

FOREIGN PATENT DOCUMENTS

DE 29708625 7/1997
JP 1973896376 11/1973
(Continued)

OTHER PUBLICATIONS

Office action for U.S. Appl. No. 14/542,297, dated Apr. 6, 2017, Lutes, "Wet Screed Hardware System", 23 pages.
(Continued)

*Primary Examiner* — Michael Safavi
(74) *Attorney, Agent, or Firm* — Lee & Hayes, PLLC

(57) ABSTRACT

A concrete forming stake apparatus including a base member having a planar side and a stake mounting port disposed opposite the planar side. The apparatus further includes a stake attachment unit including a tubular portion that engages with the stake mounting port, and a joint connected to the tubular portion. The apparatus further includes a stake that attaches to the joint.

20 Claims, 20 Drawing Sheets

(56) References Cited

U.S. PATENT DOCUMENTS 3,797,800 A * 3/1974 Loy ..... E02D 27/02 249/13
3,798,856 A * 3/1974 Gloskowski ..... E04G 21/26 248/354.3
3,964,220 A 6/1976 Rutkowski et al.
4,158,937 A 6/1979 Henry
4,321,024 A * 3/1982 Terraillon ..... E01C 19/502 249/1
4,371,330 A 2/1983 Heffernan
4,663,796 A 5/1987 Helling et al.
4,740,348 A 4/1988 Rose
4,934,643 A * 6/1990 Militano, Jr. ..... E04G 21/10 248/124.2
5,173,004 A 12/1992 Fahrenkrog
5,190,401 A 3/1993 Wilson
5,257,764 A 11/1993 Spaulding
5,288,166 A 2/1994 Allen et al.
5,468,095 A 11/1995 Dawson
5,540,519 A 7/1996 Weber
5,564,235 A * 10/1996 Butler ..... E02D 27/00 16/260
5,590,494 A 1/1997 Miller
5,800,891 A 9/1998 Wasitis
5,946,871 A 9/1999 Kassardjian et al.
5,956,912 A 9/1999 Carter et al.
6,182,416 B1 2/2001 Brackin
6,223,495 B1 5/2001 Shaw et al.
6,413,004 B1 7/2002 Lin
6,536,737 B1 * 3/2003 Davis ..... E04G 13/00 249/210
6,548,164 B1 4/2003 Bacon, Jr.
6,585,201 B1 * 7/2003 Reed ..... B60R 11/0235 248/181.1
6,709,194 B1 3/2004 Grimes
6,719,486 B2 4/2004 Craghan
6,854,919 B2 2/2005 Neumann et al.
6,866,445 B2 3/2005 Semler
7,086,203 B2 8/2006 Owen
7,152,378 B2 12/2006 Takagi et al.
7,562,495 B1 7/2009 Fairchild et al.
7,610,728 B1 11/2009 Manocchia
7,621,694 B1 11/2009 Goodman et al.
8,132,774 B1 * 3/2012 Whatcott ..... E01C 19/502 249/34
8,733,728 B2 * 5/2014 Reilly ..... E04G 17/14 249/219.1
2002/0157203 A1 10/2002 Aguilera
2002/0192415 A1 12/2002 Vogler et al.
2003/0068200 A1 4/2003 Quenzi et al.
2004/0071509 A1 4/2004 Frankeny, II
2004/0168330 A1 9/2004 Kim
2005/0069385 A1 3/2005 Quenzi et al.
2005/0163566 A1 7/2005 Lindely
2005/0207843 A1 9/2005 Jackson
2005/0218277 A1 10/2005 Shaw et al.
2006/0107617 A1 5/2006 Scott et al.
2006/0192073 A1 8/2006 Casale
2006/0201092 A1 9/2006 Saathoff et al.
2007/0144080 A1 6/2007 Berner
2007/0166104 A1 7/2007 Face, III
2007/0201302 A1 8/2007 Lindley
2007/0278366 A1 * 12/2007 McGill ..... F16M 13/00 248/176.3
2007/0292208 A1 12/2007 Lutz et al.
2008/0031689 A1 2/2008 Face et al.
2008/0202052 A1 8/2008 Meier
2009/0183451 A1 7/2009 Andreasen et al.
2009/0226257 A1 9/2009 Lindley
2009/0272873 A1 * 11/2009 Fittler ..... E04G 17/14 249/3
2010/0139196 A1 6/2010 Healy
2010/0183369 A1 7/2010 Lindley
2010/0218438 A1 * 9/2010 Sollars ..... E04G 13/00 52/127.2
2010/0221067 A1 9/2010 Kahle
2010/0226718 A1 9/2010 Obergfoll
2011/0188930 A1 8/2011 Lura
2012/0168593 A1 * 7/2012 Mekid ..... F16M 11/043 248/398
2014/0150356 A1 6/2014 Reed
2016/0138280 A1 5/2016 Lutes
2016/0138281 A1 5/2016 Lutes

FOREIGN PATENT DOCUMENTS

JP 1976049796 12/1976
JP 1984167149 11/1984
JP 1993073157 10/1993
JP 1996003594 1/1996
JP 2004522024 7/2004
JP 2010019411 1/2010

OTHER PUBLICATIONS

Office Action for U.S. Appl. No. 14/542,339, dated Oct. 20, 2015, James Steven Lutes, "Wet Screed with Hardware System", 13 pages.
Office action for U.S. Appl. No. 14/542,339, dated Nov. 9, 2016, Lutes, "Wet Screed with Hardware System", 16 pages.
Office action for U.S. Appl. No. 14/542,297, dated Dec. 1, 2016, Lutes, "Wet Screed Hardware System", 19 pages.
Office action for U.S. Appl. No. 14/542,339, dated Feb. 8, 2016, Lutes, "Wet Screed with Hardware System", 16 pages.
Office action for U.S. Appl. No. 14/542,339, dated Mar. 3, 2017, Lutes, "Wet Screed with Hardware System", 17 pages.
Office action for U.S. Appl. No. 14/542,297, dated May 19, 2016, Lutes, "Wet Screed Hardware System", 14 pages.
Office action for U.S. Appl. No. 14/542,339, dated May 20, 2016, Lutes, "Wet Screed with Hardware System", 17 pages.
PCT Search Report and Written Opinion dated Feb. 2, 2016 for PCT application No. PCT/US2015/060447, 9 pages.

* cited by examiner

CONCRETE FORMING STAKE APPARATUS

BACKGROUND

Concrete forms are used to frame an area where a concrete slab is to be formed. In many instances, a concrete forming stake may be used to hold a form in place while concrete is being poured. After the concrete is poured, the stakes further provide support while the concrete is curing. Conventional concrete forming stakes are steel rods having a spike on one end and a plurality of holes traversing the stake. The holes are nail holes in which a nail may be placed to secure the stake in place against the forms. In many instances, the stakes are hammered into an adjacent subgrade or surface at an angle with respect to the plane of the subgrade or surface to provide support and resistance to movement of the forms as the concrete is poured. Stakes may also be hammered into the subgrade or surface to position the stake at or near a position perpendicular to the plane of the surface.

Moreover, vapor barriers are occasionally used in concrete applications. The vapor barrier is placed underneath the area to be poured to provide resistance to or prevent moisture vapor from transmitting though the concrete into the building envelope. However, when used in conjunction with vapor barriers, the concrete forming stakes used to secure the forms puncture the vapor barrier and therein reduce the utility.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

Figure 1:
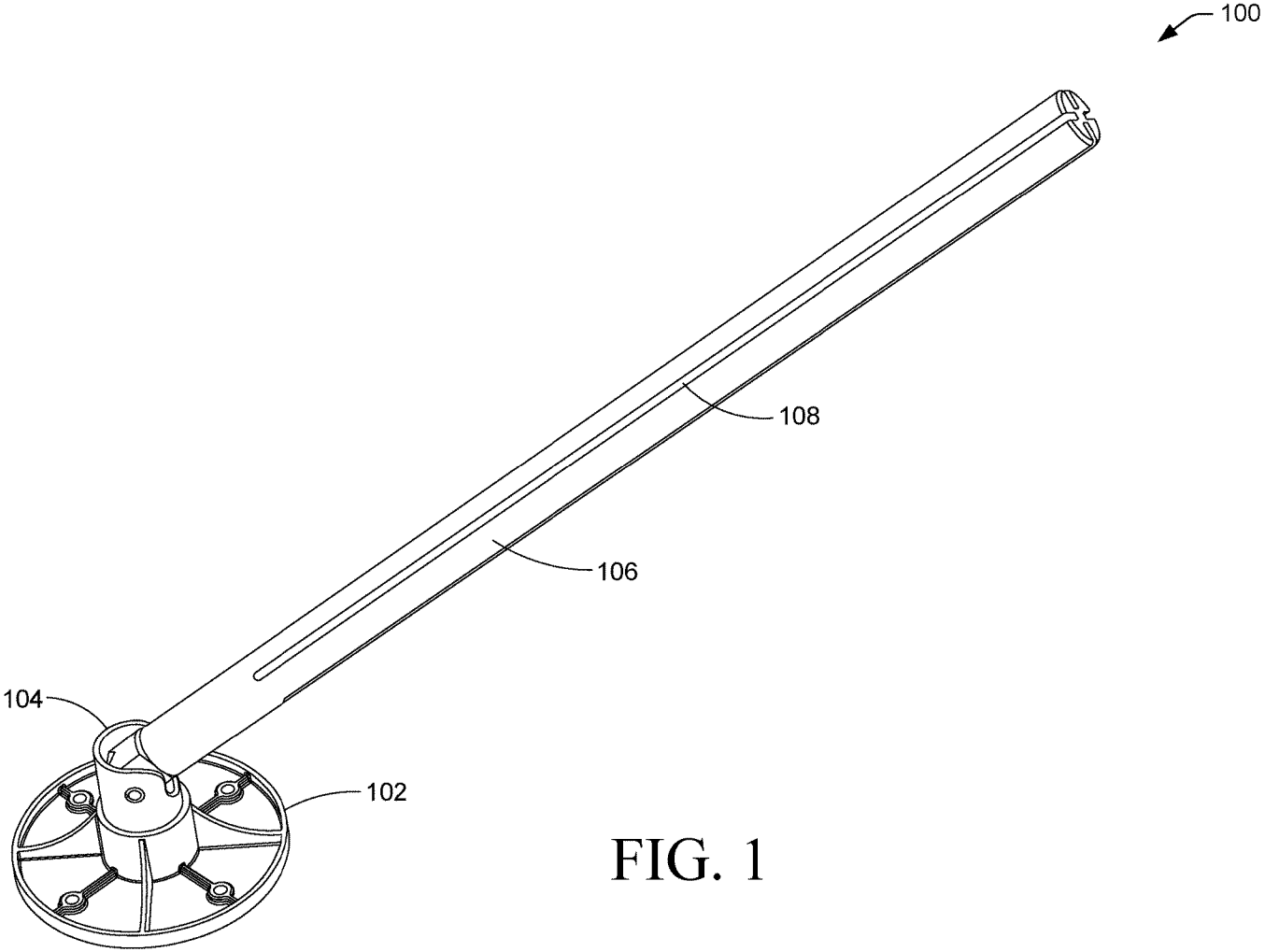
FIG. 1 illustrates a perspective view of a concrete forming stake apparatus according to an embodiment of the application.

Concrete forms are frequently supported and held in place by placing a nail through a predefined hole in a steel concrete stake that is hammered into a subgrade or surface. By hammering the stake into the subgrade or surface, the stakes support and resist movement of the forms. Such stakes, however, limit a user's placement of the nails into the concrete forms, as they may cause the user to have to position the stakes further into the ground and/or alternatively, rotate the stake such that a predefined hole in the stake aligns with the concrete forms. Moreover, in some instances, it may be inconvenient to place a stake into a particular surface given the composition of the surface. Furthermore, such stakes, when used in conjunction with a vapor barrier, pierce the barrier, thereby creating an avenue through which moisture vapor may pass and cause moisture related issues of floor coverings and other building components.

Accordingly, this disclosure is directed to a concrete forming apparatus for assisting in supporting concrete forms used in forming a concrete slab. In some instances, the apparatus may include a base member, a stake attachment member, and a stake. The stake may be configured to be attached to the base member via the stake attachment member. The apparatus may be fastened via the base member to a subgrade or surface by adhesion or using mechanical fasteners. The subgrade or surface may be on the surface to which concrete is poured or alternatively, adjacent to a surface on which concrete is to be poured. In some instances, the apparatus is structured and configured such that, regardless of the position in which the base member is fastened to the surface, the stake may be rotatable up to 360° to permit positioning of the stake to reinforce the forms via fasteners that connect the stake to a form. Additionally, and/or alternatively, the stake may be placed in a fixed position with respect to the base.

In some instances, the stake may be used solely to support and secure the concrete forms by placing the stake(s) adjacent to concrete forms and fastening the stake thereto.

In some instances, the stake may be formed, for example via injection molding, from a strong, durable plastic material. An alternate method for forming the stake may include extrusion methods. Furthermore, in some instances, the stake may include features that assist a user in placing a fastener, such as a nail, through the stake in order to support the form.

Moreover, the apparatus may be used in conjunction with a vapor barrier without compromising the integrity of the barrier. For example, the apparatus may be secured to the vapor barrier via an adhesive means to support the form.

In another embodiment, a base unit may include multiple mounting ports in which a stake may be attached to secure a stake to a concrete form.

Additional details regarding the features of the concrete forming apparatus are described herein below.

Illustrative Embodiments of a Concrete Forming Stake Apparatus

FIG. 1 depicts a perspective view of an assembled concrete forming stake apparatus 100 according to an embodiment described herein. Elements of apparatus 100 may include a base member 102, a stake attachment member 104, and a stake 106. Discussed in more detail later, stake 106 may include channels 108 through which a nail, or other fastener, may be driven through when stake apparatus 100 is in use.

In general, when placing a form to hold concrete, stake apparatus 100 may be placed adjacent to a subgrade or surface on which concrete is poured. Specifically, base member 102 is secured to the subgrade or surface, and stake 106 may be adjusted, orientated, or positioned with respect to the form via stake attachment member 104. A fastener (not shown) may then be placed through a channel 108 of stake 106 to provide support and resistance to the form.

Figure 2:
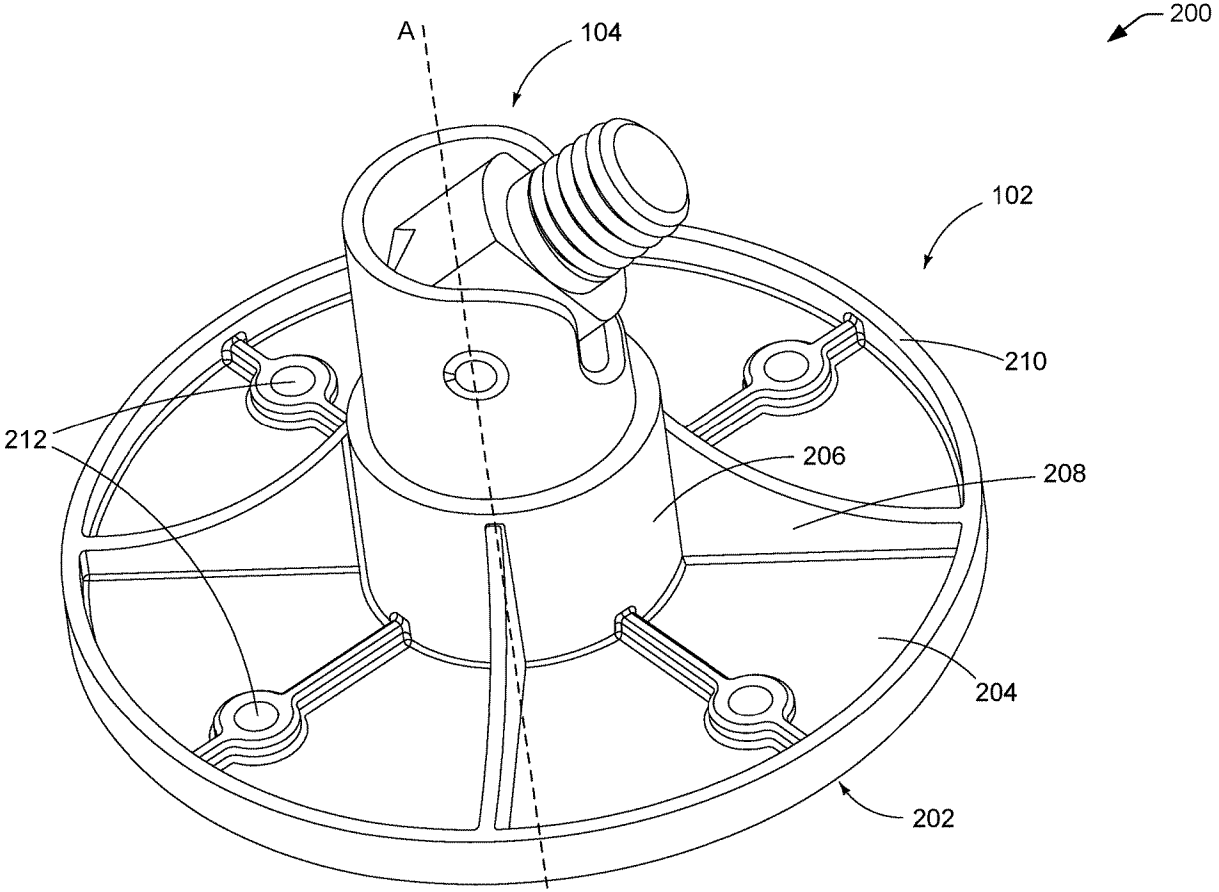
FIG. 2 illustrates a perspective view of a base member of the concrete forming stake apparatus in FIG. 1 according to an embodiment of the application.

Referring to FIG. 2, a perspective view 200 of base member 102 of FIG. 1 is shown. Base member 102 may have a planar side 202 (pointing to an underneath side of base member 102) that is placed against a surface when in use, and on a side 204 opposite to planar side 202 is included a stake mounting port 206.

Stake mounting port 206 may include a hollow receptacle oriented with an opening away from planar base 202. While stake mounting port 206 is depicted as a cylinder in the figures, other shapes having one or more walls may be accommodated, and stake mounting port 206 is not limited to a cylinder. Stake mounting port 206 may be configured to receive stake attachment member 104 (as further discussed herein).

The outer wall(s) of stake mounting port 206 forming the receptacle may be reinforced with one or more gussets or brackets 208 (hereinafter "gusset(s)") to increase stability and provide resistance to the stake supporting the form. Gusset 208 may be defined as a planar structural support member extending and bracing between an inner surface of flange 210 of base member 102 and the external surface of the wall(s) of stake mounting port 206. Additionally, and/or alternatively, gusset 208 may extend and brace between side 204 and the external wall(s) of stake mounting port 206. When implementing a plurality of gussets 208, gussets 208 may be equally spaced and symmetric about a central axis A of stake mounting port 206. However, gussets 208 may take other forms not shown herein in order to reinforce stake mounting port 206. Moreover, gussets 208 may be of various sizes and thickness relative to one another.

Base member 102 may further include pre-formed fastener holes 212 dispersed around base member 102 surrounding stake mounting port 206. Fastener holes 212 may be of varying sizes or may be uniform in size, may be placed randomly or in a pattern throughout base member 102, and/or may extend partially or completely through base member 102, so as to be open on planar side 202 and on side 204. Fastener holes 212 may accommodate the passage of one or more nails and/or screws, or other fasteners, to secure base member 102 to a surface or subgrade and thereby provide support and resistance applied while concrete is poured or curing.

Figure 3:
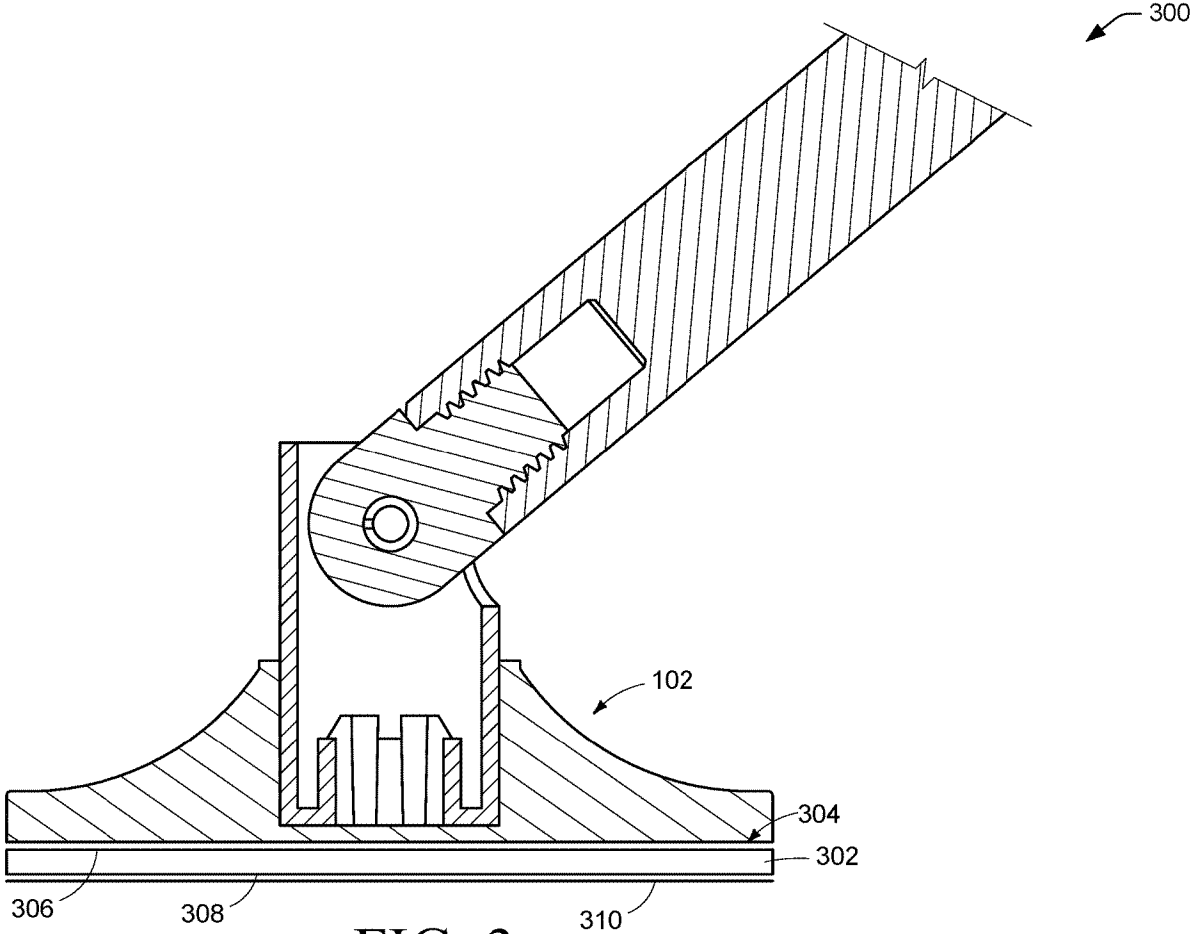
FIG. 3 illustrates a cross-sectional view of the base member in FIG. 2 according to an embodiment of the application.

Additionally, and/or alternatively, base member 102 may be secured to a surface or subgrade, including a surface or subgrade having a vapor barrier thereon, via an adhesive. As depicted in FIG. 3, cross-sectional view 300 illustrates base member 102 having an adhesive layer 302. Adhesive layer 302 may be used alone or in combination with hardware fasteners such as those described above with respect to FIG. 2, to secure base member 102 to a surface. That is, both fasteners protruding through fastener holes 212 of FIG. 2 and adhesive layer 302 may be used to secure base member 102.

Adhesive layer 302 may be applied to planar side 304 of base member 102. In some instances, adhesive layer 302 may be pre-applied to base member 102 or may be applied at or near the time of use. A peelable cover or film 310 (hereinafter "cover") may be applied to one or both surfaces 306, 308 of adhesive layer 302 for quick and easy removal at the time of use. Cover 310 may also prevent the adhesive 302 from being exposed to detrimental environmental debris and moisture prior to use. When in use, surface 306 contacts planar side 304 of base member 102, while surface 308 contacts a subgrade or surface to secure base member 102.

While shown in FIG. 3 as being uniform with base member 102, it is noted that adhesive layer 302 may be of any shape and size that accommodates base member 102 in order to secure concrete forming apparatus to the subgrade or surface. For example, adhesive layer 302 may be larger than a footprint of base member 102 or of a different shape, or alternatively, it may be smaller than the footprint of base member 102.

Figure 13:
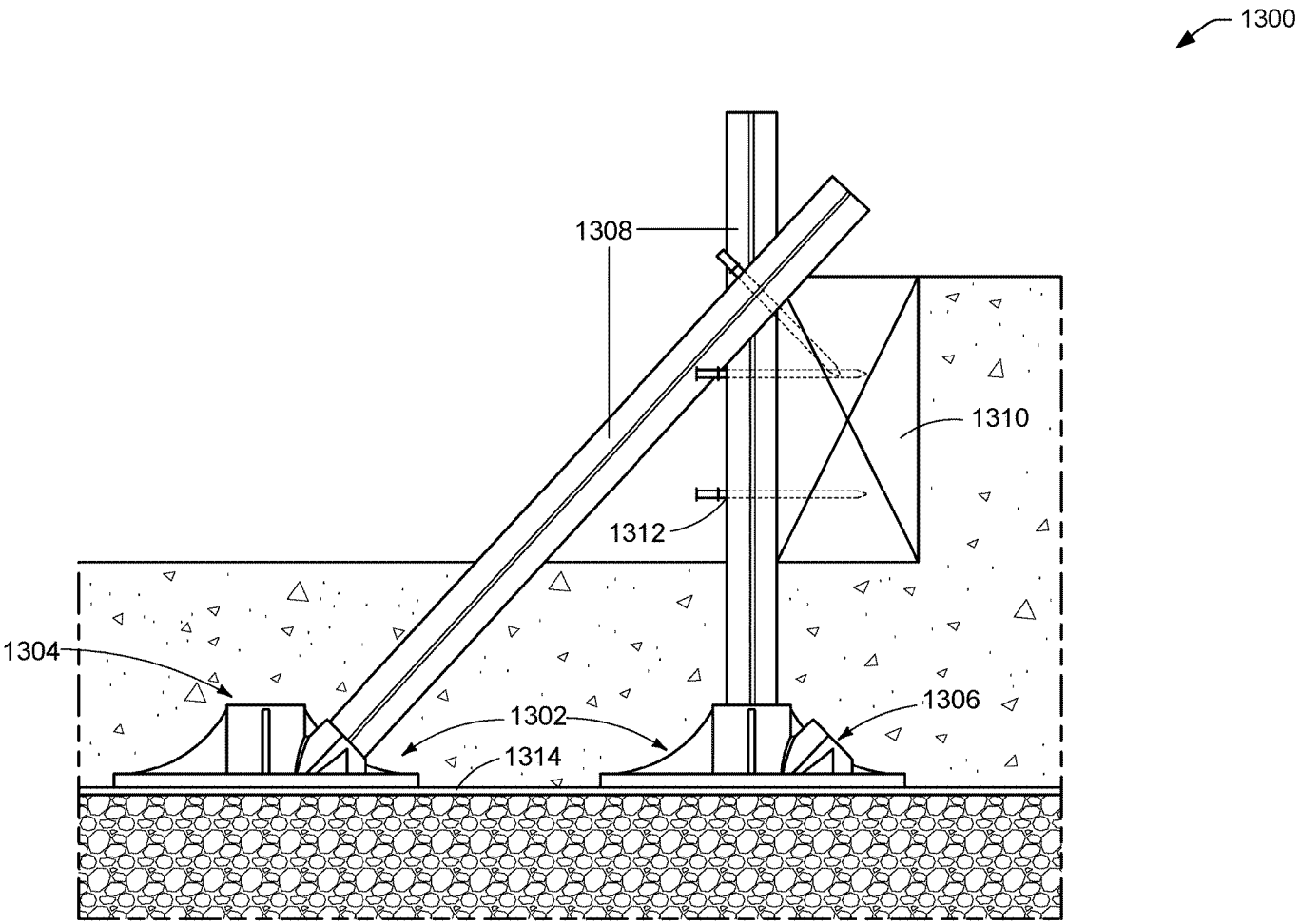
FIG. 13 illustrates a side view of a concrete forming stake apparatus according to another embodiment of the application.

As mentioned above, adhesive layer 302 may be attached to a surface where a vapor barrier is placed (see FIG. 13). Adhesive layer 302 allows base member 102 to be secured to the vapor barrier or other surface without the use of nails, screws, or other mechanical fasteners that may otherwise pierce or compromise the vapor barrier. Accordingly, by eliminating mechanical fasteners, the integrity of the vapor barrier is maintained to prevent moisture vapor from transmitting through the concrete. Further, adhesive layer 302 is sufficiently strong to secure the concrete forming apparatus 100 in place with the concrete forms.

Figure 4:
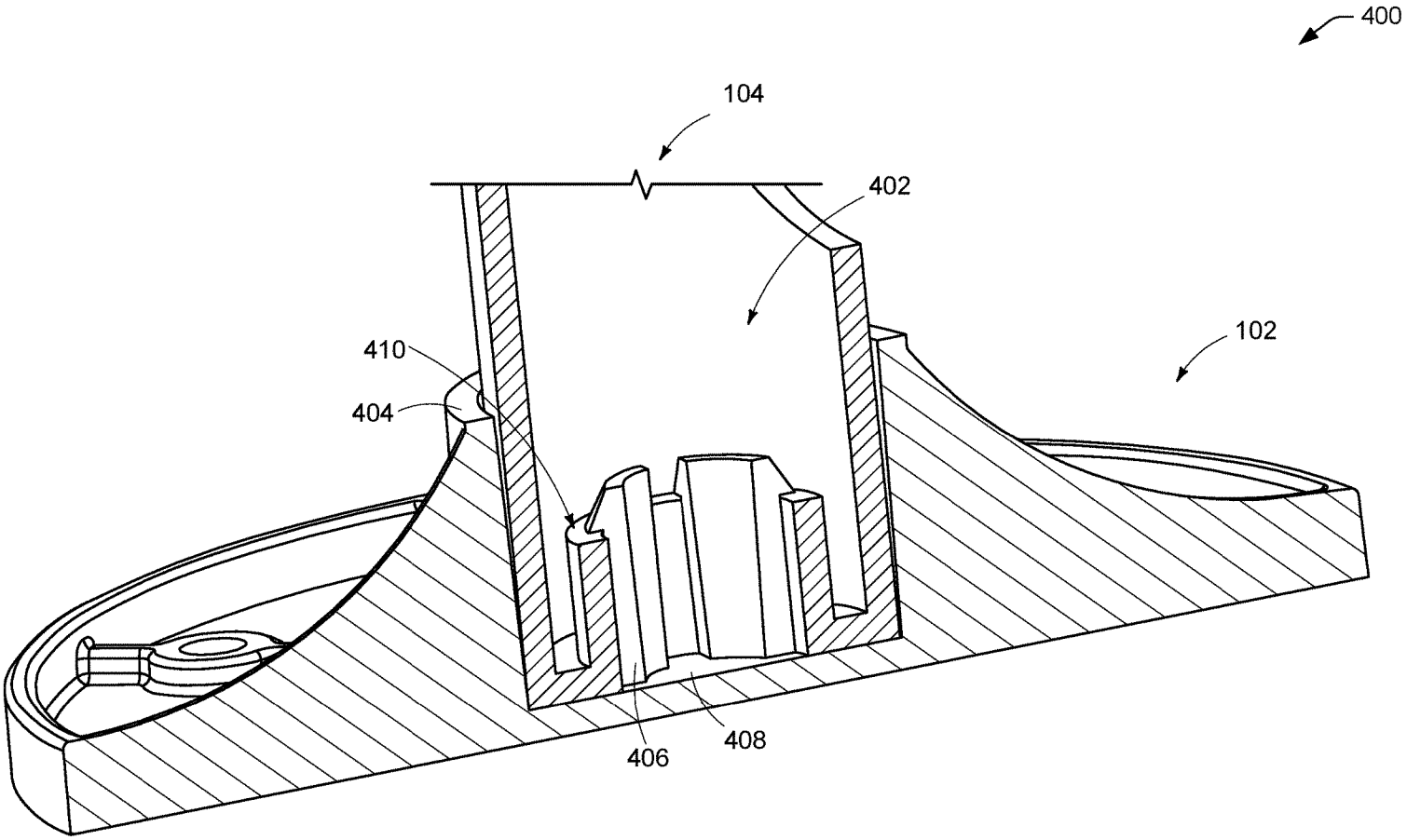
FIG. 4 illustrates a perspective view of a cross section of the base member in FIGS. 2 and 3 according to an embodiment of the application.

FIG. 4 illustrates a cross-sectional perspective view 400 of the base member 102 and stake attachment member 104. As depicted, base member 102 may have a latching/locking system 402. The latching/locking system 402 may be integral or may be formed separately from base member 102. In some instances, latching/locking system 402 may be incorporated within the interior of stake mounting port 404 (see also 206 of FIG. 2) to assist in securing stake attachment member 104 to base member 102. In some instances, latching/locking system 402 may include one or more hooked tabs 406 extending vertically from an upper surface 408 of base member 102 into the hollow receptacle of stake mounting port 404. Tabs 408 are flexible so as to deflect inward and return to an original position, at which position the hooks of tabs 408 may engage a surface 410 of stake attachment member 412, thereby securing stake attachment member 104 to base member 102. When implementing a plurality of tabs 406, tabs 406 may be spaced equally and symmetric about an axis of base member 102. However, latching/locking system 402 may take other forms not shown herein in order to secure stake attachment member 104 to base member 102.

For example, in an alternative embodiment not shown, a latching/locking system may include vertically extending hooked tabs, similar to those shown in FIG. 4, however, the tabs may be disposed closer to inner wall of stake mounting port, and may engage directly with an inner surface of an outer wall of stake attachment member. That is, the walls of the stake attachment member may have an annular groove on an inner wall surface to engage the tabs and allow free rotation between the components.

Furthermore, in another alternative embodiment not shown, a screw system may be used in place of the latching/locking system. The stake mounting port of the base member may have a male/female threaded feature, while the stake attachment member may have a corresponding male/female threaded feature, thereby allowing a threaded connection between the stake attachment member and the base member. As such, both a rotational position and a height position of the stake attachment member may be adjusted.

Figure 5:
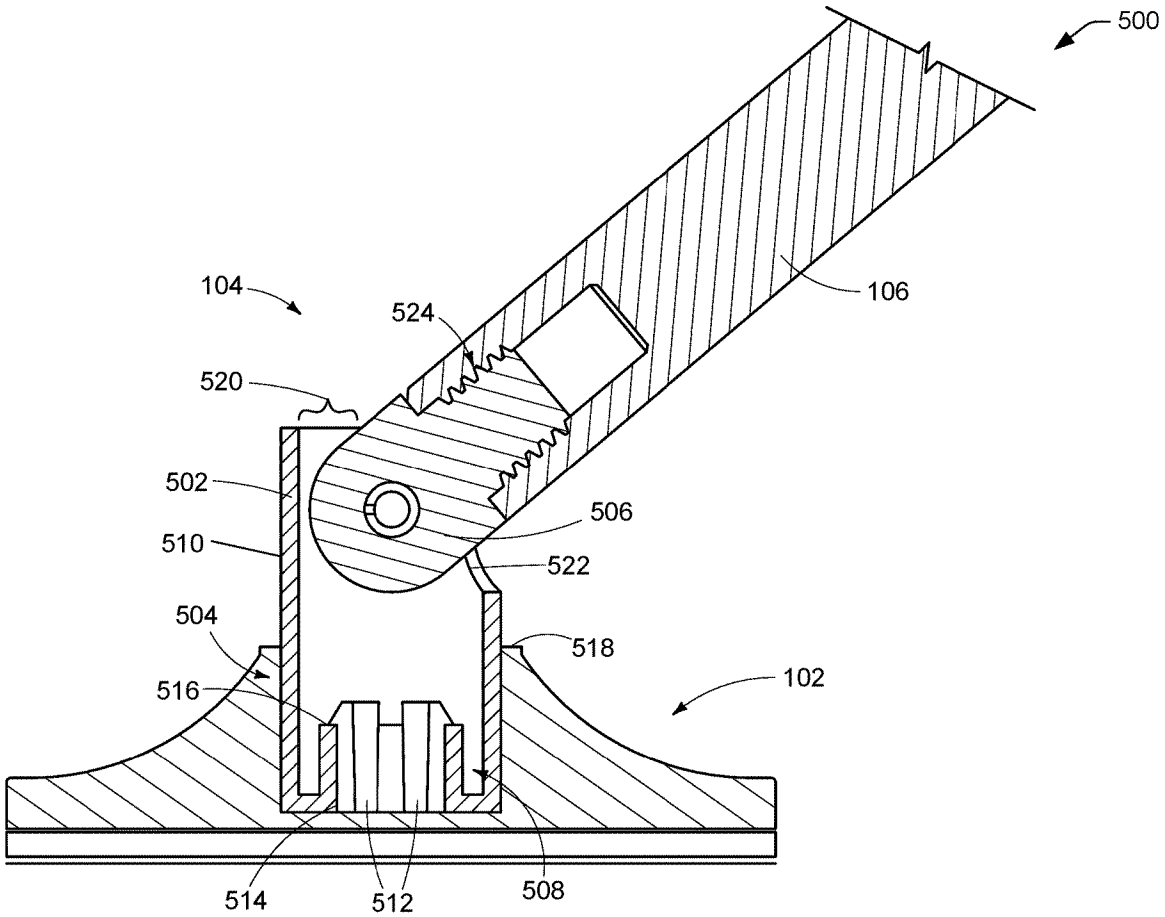
FIG. 5 illustrates a cross-sectional view of the base member in FIG. 2 according to an embodiment of the application.

FIG. 5 illustrates a side cross-sectional view 500 of base member 102 and stake attachment member 104 connected to stake 106. Stake attachment member 104 may have one or more sub-components, such as a tubular portion 502 that engages with stake mounting port 504, and joint 506 connected to tubular portion 502. Stake attachment member 104 may lock or latch into stake mounting port 504 of base member 102 in many possible ways, including with latching/locking system 402 as described above.

Tubular portion 502 may be sized to fit coaxially within the wall(s) of stake mounting port 504. As depicted in the cross-sectional views in FIGS. 3 and 4, the bottom end ("base end") of tubular portion 502 may include inner tubular section 508 connected coaxially to an exterior wall 510 of tubular portion 502. Inner tubular section 508 may have a smaller diameter than exterior wall 510 of tubular portion 502 and may be open at the outer end thereof. Further, the diameter of the opening in inner tubular section 508 may be sized to be smaller than a greatest dimension width across the outer edges of hooks on opposing tabs 512. As such, when tubular portion 502 of stake attachment member 104 is inserted into stake mounting port 504, edge 516 of the opening on inner tubular section 508 contacts the hooks on tabs 512 and flexes the tabs inward such that tabs 512 slide into inner tubular section 508 along the inside wall 514 of inner tubular section 508. A length of inner tubular section 508 is not greater than a height of the portion of a tab 512 that extends from the surface of base member 102, from which the tab extends, to the underside of the hook. Thus, when tubular portion 502 has been inserted completely into stake mounting port 504, tabs 512 return from a flexed position to the original position such that the hooks of tabs 512 extend over and catch inside edge 516 of inner tubular section 508 to latch/lock it in to stake mounting port 504. Accordingly, once latched or locked in, stake attachment member 104 will be in a vertical position.

After being latched/locked into position, base member 102 may support stake 106 when fastened to a concrete form. With the described latch/lock system in the above embodiments and figures, the lock may merely inhibit extraction of tubular portion 502 in a single direction. For example, stake attachment member 104 may be unable to be removed from base member 102 through pulling in an opposite direction to which stake attachment member 104 was attached to stake mounting port 504. Moreover, tubular portion 502 is free to rotate axially about base member 102 up to 360°.

With respect to the top end ("stake end") of tubular portion 502 of stake attachment member 104, which is opposite the base end, stake attachment member 104 extends above surface 518 of stake mounting port 504. In addition, tubular portion 502 of stake attachment member 104 also has an opening 520 that permits movement of joint 506 within the cavity of stake attachment member 104. The stake end further includes a slot (discussed in more detail in FIG. 6) that extends from opening 520 down a sidewall 522 of tubular portion 502.

As stated above, joint 506 is used to attach stake 106 to base member 102. Joint 506 may attach to stake 106 in a variety of different ways. For example, in some instances, as depicted and described in FIG. 5, joint 506 may have a male threaded end 524 that corresponds to a female threaded end on stake 106. Alternatively, joint 506 may have a female threaded end and stake 106 may have a correspondingly sized male threaded end (not shown); or, stake 106 may be attached or otherwise coupled to stake attachment member 104 using a pin that traverses joint 506 and stake 106 (also not shown).

Figure 6:
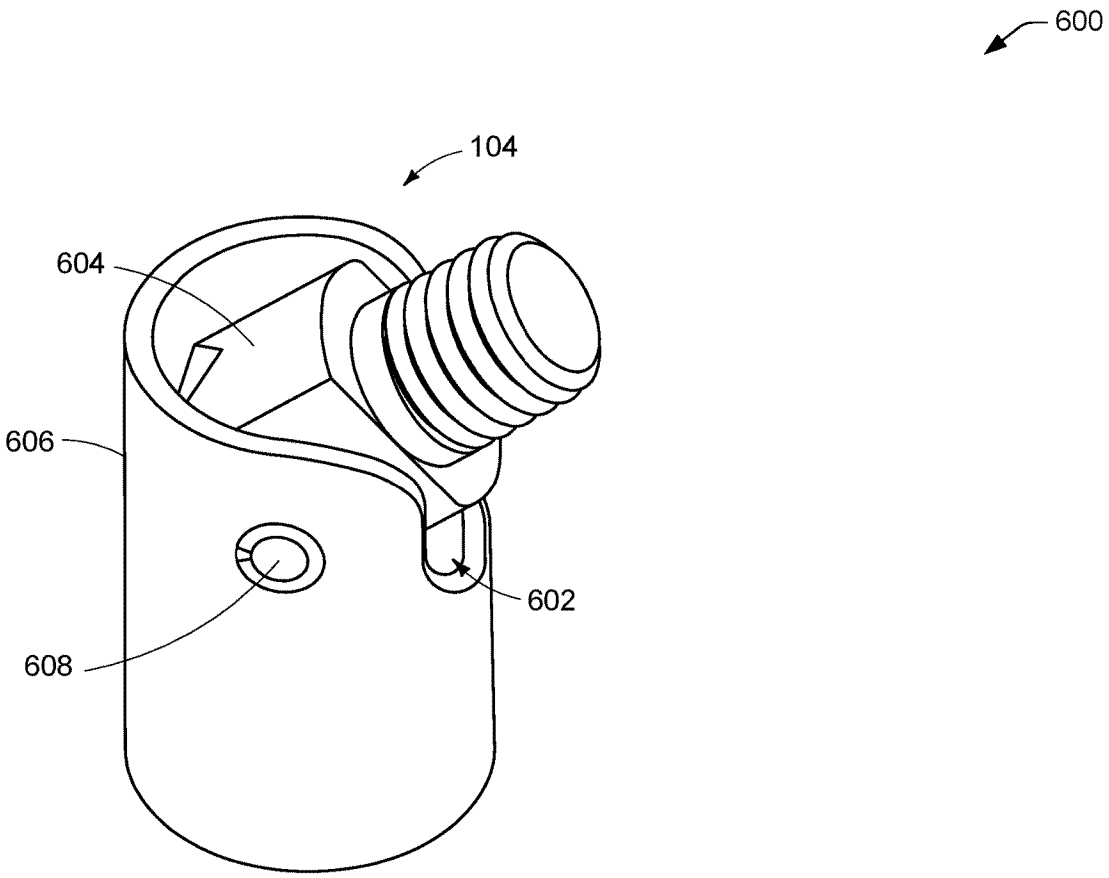
FIG. 6 illustrates a perspective view of a stake attachment member of the concrete forming stake apparatus in FIG. 1 according to an embodiment of the application.

Shown in FIG. 6 is a perspective view 600 of the stake attachment member 104 of the stake forming apparatus. As mentioned above, the stake end of stake attachment member 104 includes slot 602 to allow pivotal passage of joint 604 through slot 602. In some instances, joint 604 may be attached to the stake end of tubular portion 606 via pin 608. However, alternative fasteners, molded tabs, or retaining members may be used to permit such pivoting.

Pin 608 permits joint 604 to be pivoted about an axis of pin 608. In some instances, joint 604 is connected to the stake end of stake attachment member 104 via pin 608 that passes through a hole in a first end of joint 604. Pin 608 is further engaged with tubular portion 606 adjacent to slot 602 in order to secure joint 604 to tubular portion 606 and hold joint 604 in position with the single point on pin 608. Accordingly, as described and depicted, joint 604 is able to pivot on pin 608 from a vertical position to a horizontal position within slot 602.

Figure 7:
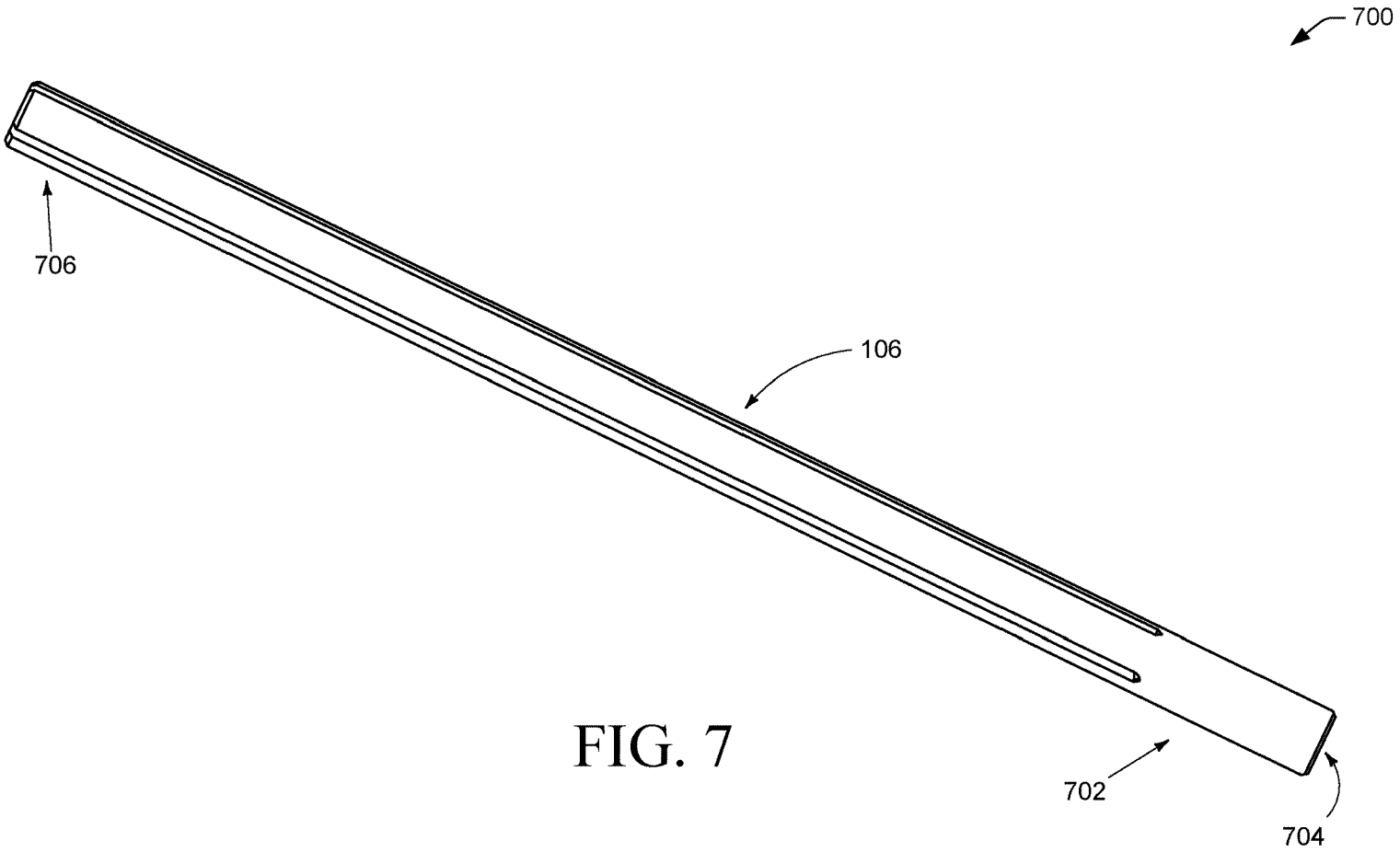
FIG. 7 illustrates a perspective view of a stake of the concrete forming stake apparatus of FIG. 1 according to an embodiment of the application.

FIGS. 7-10 depict various views of a stake 106 of FIG. 1 according to an embodiment of this application. In FIG. 7, perspective view 700 shows stake 106 may be an elongated rod formed of a high strength and/or high durability plastic. However, other suitable materials may be used for stake 106 as well. Proximal end 702 of stake 106 includes a feature to connect stake 106 to the stake attachment member. For example, as discussed above, in some instances, the feature on proximal end 702 of stake 106 may be a female threaded segment 704 (pointing to inside proximal end 704) to engage with a male threaded end of the joint. Alternatively, proximal end 702 of stake 106 may have a male threaded segment to engage with a respective female threaded end of the joint (not shown). A threaded connection may provide the ability to easily and securely adjust a length of extension of stake 106, if necessary. Opposite proximal end 702 of stake 106 is distal end 706.

Figure 8:
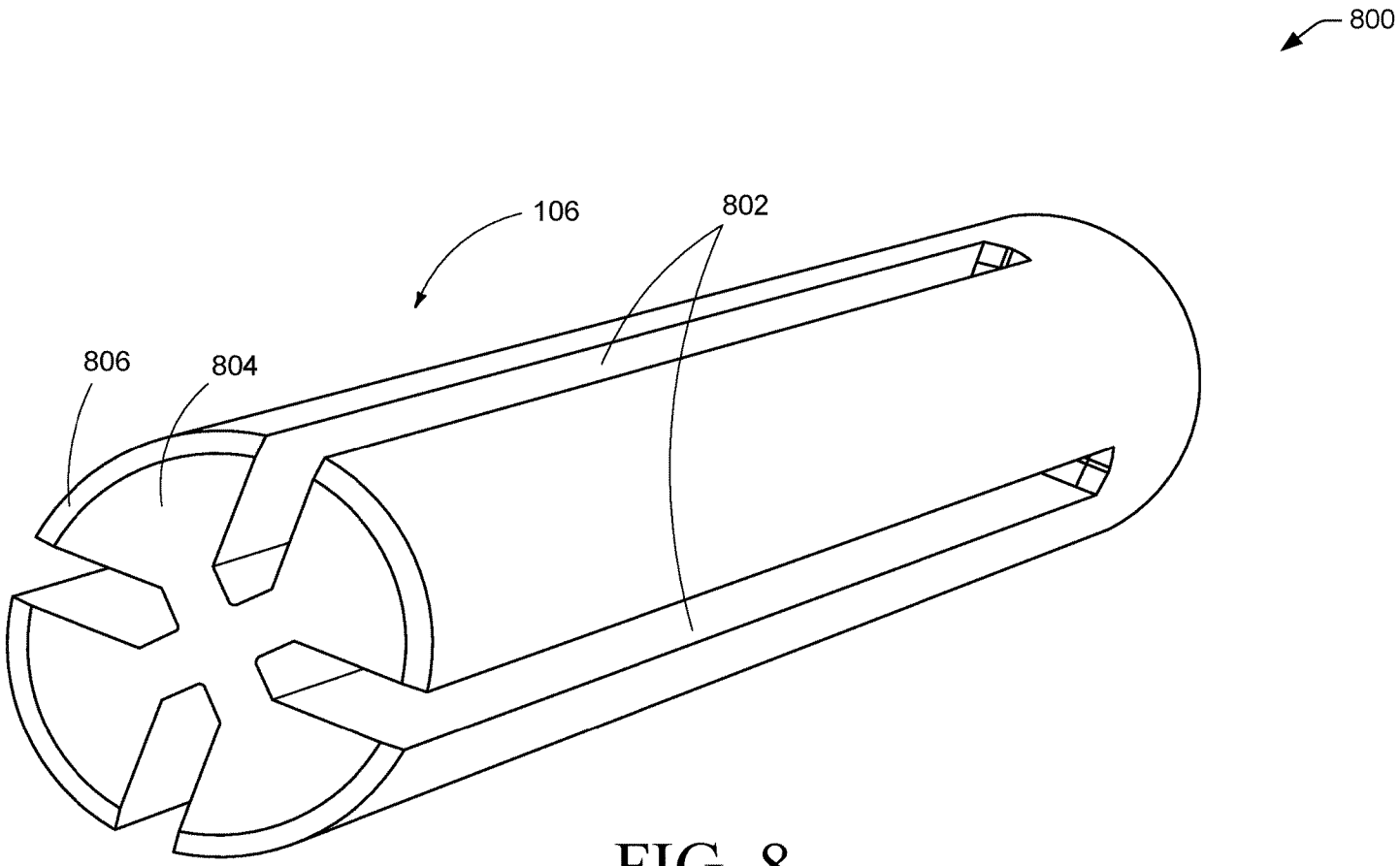
FIG. 8 illustrates a perspective view of the distal end of the stake in FIG. 7 according to an embodiment of the application.

In FIG. 8, a perspective view 800 shows stake 106 as seen from the distal end of stake 106. Stake 106 may include one or more channels, grooves, troughs, or indentations 802 (hereinafter "channels") that extend along at least a portion of stake 106 in a lengthwise direction. As depicted, channels 802 may extend in a straight line from a middle section of the stake (toward the proximal end) through the end surface of stake 106 at the distal end. Additionally, and/or alternatively, channels 802 may extend in zigzag, helical, or in annular/circumferential directions along a length of stake 106. Furthermore, channels 802 may extend across a segment length less than half the length of stake 106, and/or may extend up to, but not through the end surface of the distal end.

With respect to the radial depth of channels 802, that is the amount in which the channels extend into stake 106, channels 802 may extend radially into stake 106 to the extent that they do not intersect with each other. For example, in some instances, channels 802 may extend a radial depth less than half the diameter of stake 802 so that the divided section(s) of the stake remain interconnected.

Channels 802 in stake 106 provide a place through which a nail or other fastener may be driven by a user when the stake apparatus is in use. Specifically, a fastener may be driven into a concrete form after passing through one or more channels 802 of stake 106 to secure the stake apparatus to the form. Moreover, one or more pre-formed holes (not shown) may be included in the plastic that extend through a thickness of the stake in a direction perpendicular to the axis of the stake, for convenient use as the position of the stake on the form permits.

Through the incorporation of channels 802 extending along the length of stake 106, the stake 106 may be secured more easily to the form by inserting a fastener anywhere along the length of stake 106. In contrast, the preformed, fixed-location holes in conventional steel stakes only permit a fastener to be driven through in a specific spot.

Further, stake 106 may be formed as a composite of two materials 804, 806. For example, the core (shown by reference number 804) of stake 106 may be formed of a different material than a material used as a shell or cover on the outer surface of the stake (shown by reference number 806). For example, one material of stake 106 may provide rigidity and strength to maintain the shape of stake 106, while the other material may be a softer material used to provide easier passage of a nail therethrough. Accordingly, any combination of materials may be used to achieve desired characteristics.

Figure 9:
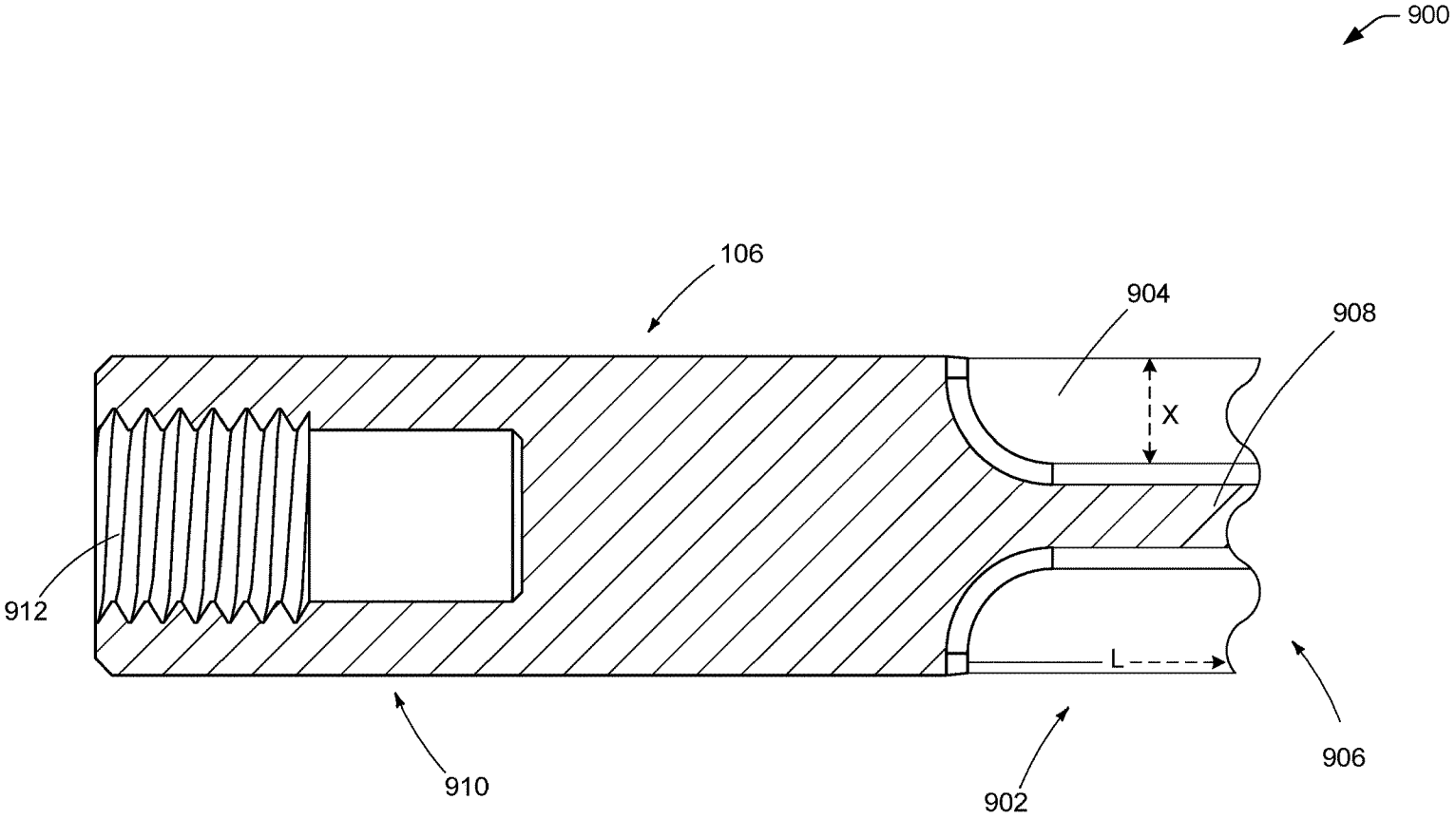
FIG. 9 illustrates a cross-sectional view of a portion of the stake in FIG. 7 according to an embodiment of the application.

FIG. 9 illustrates a cross-sectional view 900 of stake 106. Distal end 902 of stake 106 is shown having channels 904 that extend into stake 106 at a radial depth X and at a length L extending out toward end surface 906 of distal end 902. As depicted, channels 904 do not intersect one another from an opposite surface of stake 106, thereby leaving an inner medium 908 through which a fastener may be driven. On proximal end 910, stake 106 may have a female threaded segment 912 to engage with a male threaded end of the joint (FIG. 5).

Figure 10:
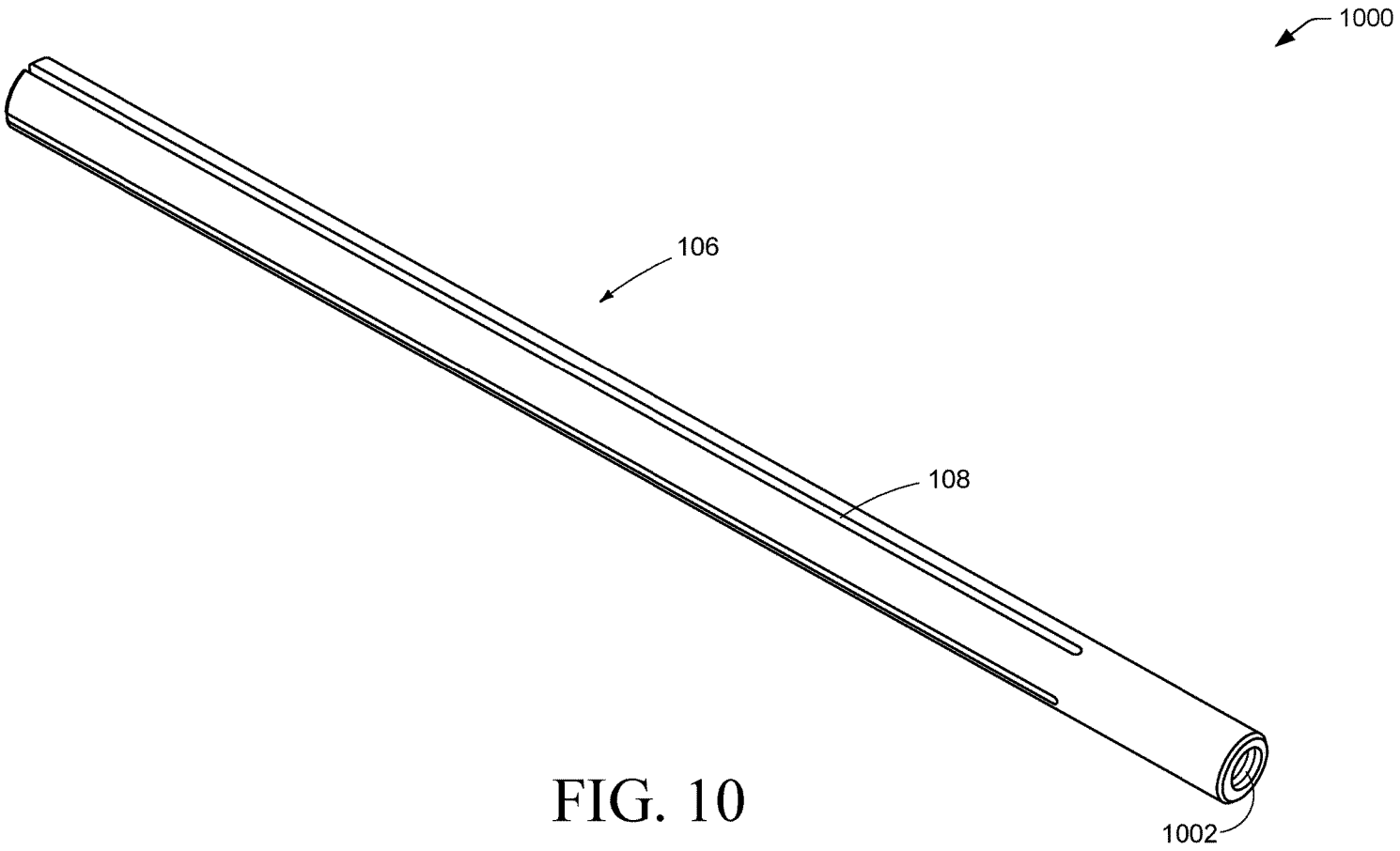
FIG. 10 illustrates a perspective view of the stake of FIG. 7 showing the proximal end of the stake according to an embodiment of the application.

FIG. 10 illustrates another perspective view 1000 of stake 106. As shown, stake 106 has channels 108 that extend into stake 106 and along a lengthwise direction of stake 106. As discussed previously, on the proximal end of stake 106, female threaded segment 1002 may be included to engage with a male threaded end of the joint of stake attachment member.

Figure 11:
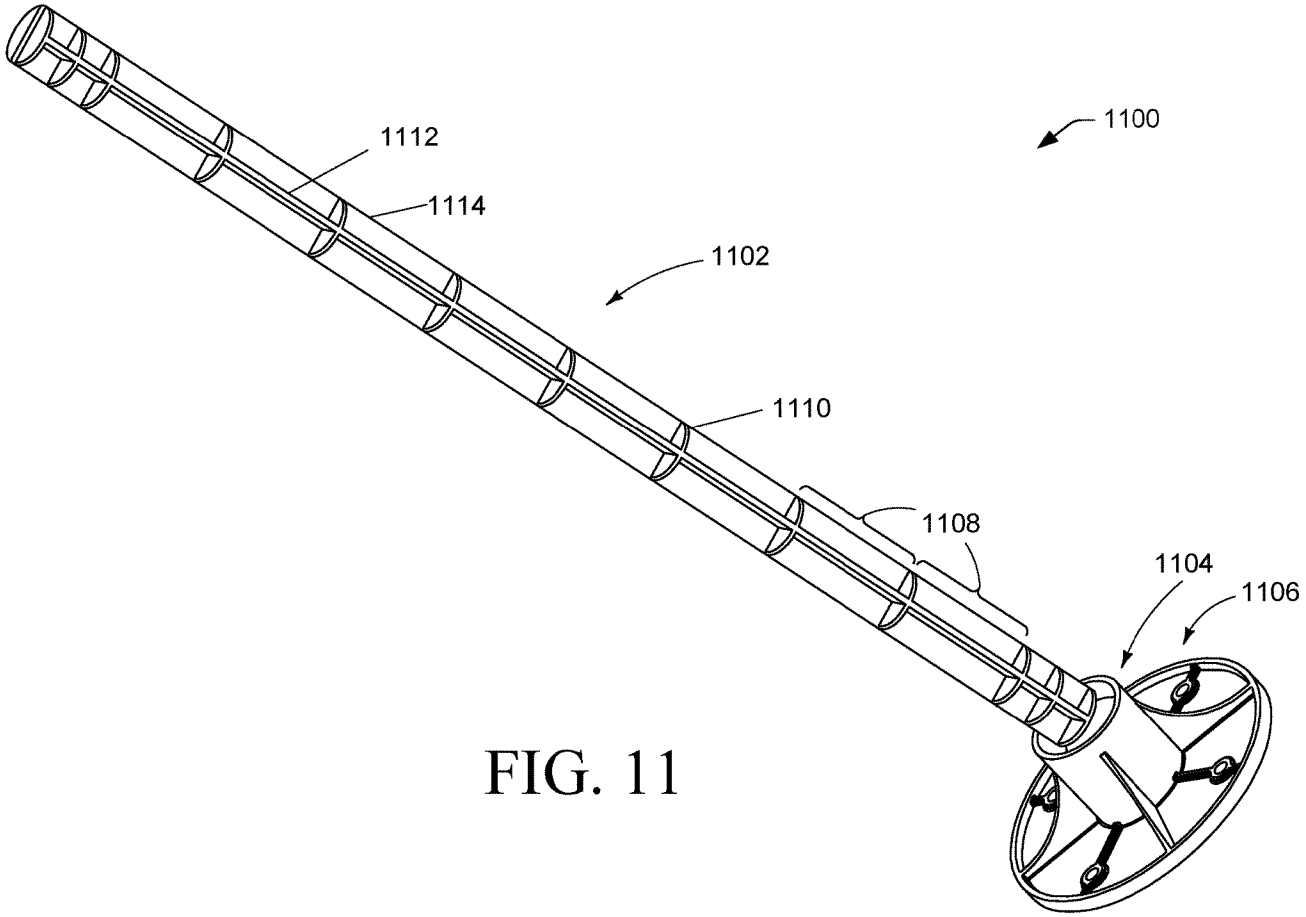
FIG. 11 illustrates a perspective view of a concrete forming stake apparatus according to another embodiment of the application.
Figure 12:
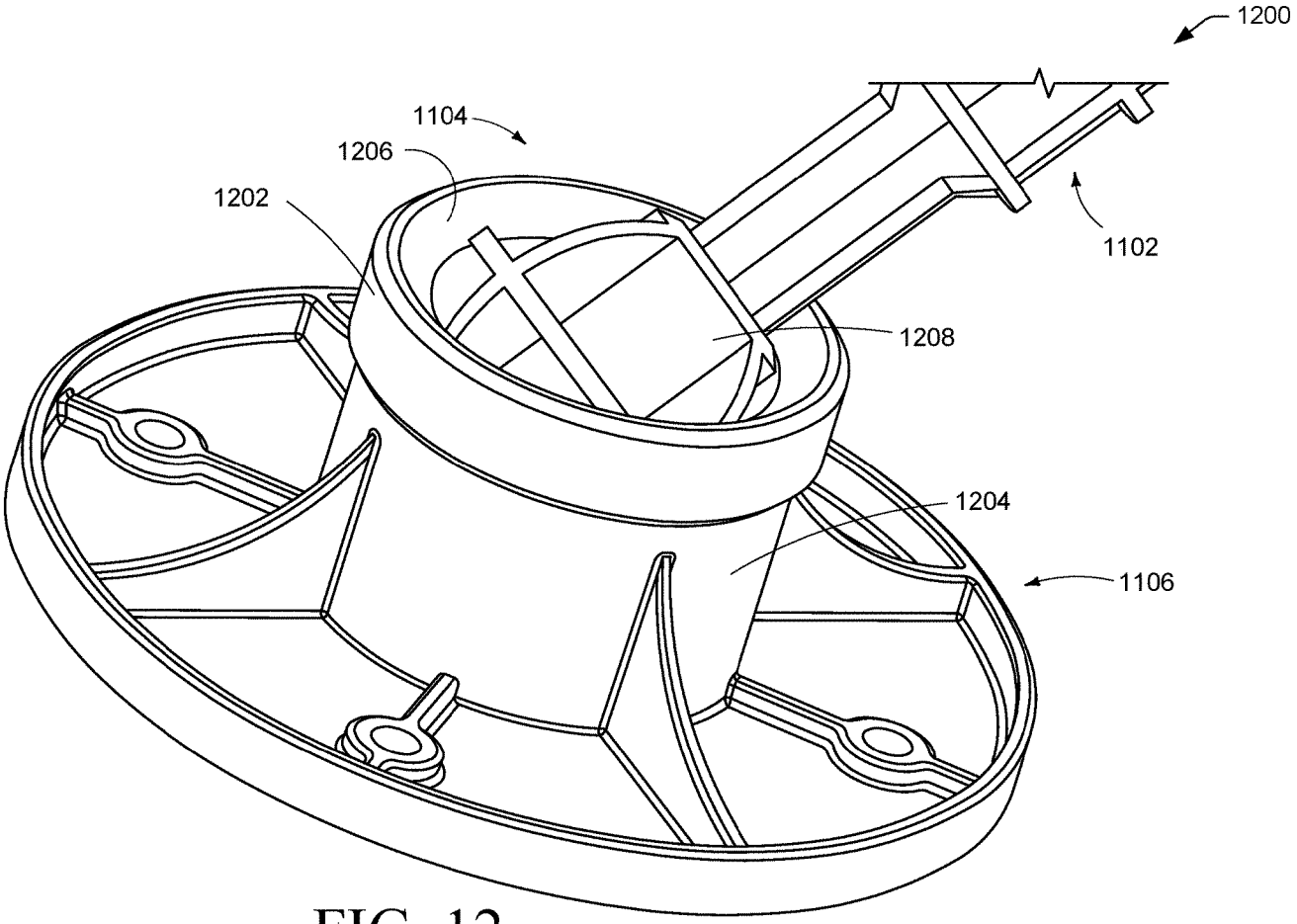
FIG. 12 illustrates a perspective view of a base member of the concrete forming stake apparatus of FIG. 11 according to an embodiment of the application.

FIGS. 11 and 12 illustrate an alternative embodiment of a concrete forming stake apparatus. For example, as shown in FIG. 11, concrete forming stake apparatus 1100 may include stake 1102, stake attachment member 1104, and base member 1106. Stake 1102 may have an elongated shape, as shown in previous figures, yet stake 1102 may have a frame structure. That is, stake 1102 may be sectioned into quadrants 1108 defined by intersecting walls 1110 along a length of stake 1102. At least a pair of orthogonally oriented walls 1112, 1114 form a central axis of stake 1102 at the intersection thereof, and intersecting walls 1110 defining a thickness of stake 1102 are distributed along the length of stake 1102 and oriented orthogonally to each of the pair of orthogonally oriented walls 1112, 1114. In combination, intersecting walls 1110 form quadrants 1108 to provide additional rigidity to the structure of stake 1102. Stake 1102 as shown in embodiment 1100 may use significantly less material resources than does the stake illustrated in FIGS. 7-10. A nail or other fastener may be positioned along stake 1102 to secure stake 1102 to a concrete form. Additionally, or in combination, stake 1102 may include prepositioned holes as similarly described above.

FIG. 12 is a perspective view 1200 showing stake 1102 connected to base member 1106 via stake attachment member 1104. As shown and in some instances, stake attachment member 1104 may include collar 1202 or other means that surround a top edge of stake mounting port 1204. Collar 1202 may engage stake mounting port 1204, for example, using a locking/latching system as previously discussed. Alternatively, collar 1202 may be an integral feature of the top of stake mounting port 1204 such that collar 1202 is not a distinct feature of base member 1106. An inner surface 1206 of collar 1202 may slant radially inward from a first diameter to a second diameter, forming a frustoconical shaped surface.

Where collar 1202 is implemented, stake 1102 may attach to stake attachment member 1104 via a connection member 1208 in contact with a proximal end thereof. In some instances, and as shown, connection member 1208 may be at least partially spherical to permit stake 1102 to move about an axis of base member 1106. The second diameter of collar 1202 is smaller than a largest diameter of the connection member 1208 and the first diameter is larger than the second diameter. Thusly, connection member 1208, which may be integral with stake 1102 or added as a component upon assembly, may be accommodated within the diameter of stake mounting port 1204, while being restrained from removal due to the smaller sized collar 1202. Furthermore, in some instances, the proximal end of stake 1102 may have a small diameter than the distal end and facilitate connection with connection member 1208 by being pressed into a correspondingly sized opening in connection member 1208.

Alternatively, as discussed previously, stake 1102 and connection member 1208 may be a single feature, and the proximal end of stake 1102 having connection member 1208 may be pressed or snapped into collar 1202. For example, stake 1102 and connection member 1208 may be molded together. Regardless of the mode of fabrication, upon attachment, collar 1202 and connection member 1208 may allow stake 1102 to be rotated freely along both an axis of stake 1102 and radially around an axis of stake mounting port 1204 up to 360°.

FIG. 13 illustrates an alternative embodiment 1300 of a stake forming apparatus. As shown, base member(s) 1302 may include top mounting port 1304 and side mounting port 1306. Top mounting port 1304 or side mounting port 1306 may be configured to secure stake(s) 1308 used in securing a concrete form. Top mounting port 1304 may extend in a vertical direction above base member 1302 and side mounting port 1306 may be positioned or orientated at any location around an axis of top mounting port 1304. In addition, while shown at a particular angle, side mounting port 1306 may extend at a fixed angle relative to base member 1302 or top mounting port 1304 to permit the opening of side mounting port 1306 to face any outward direction. Base member 1302 may incorporate more than one side mounting port 1306 (not shown). Furthermore, both top mounting port 1304 and side mounting port 1306 may be of a same or similar size and with different or similar sized openings to allow stakes 1308 to fit therein.

Stake 1308 may have channels that extend along the length of stake 1308, as previously discussed herein, to allow stake 1308 to be fastened to concrete form 1310. That is, because the channels may traverse the lengthwise direction of stake 1308, fasteners may secure stake 1308 to concrete form 1310. As mentioned previously, compared to conventional steel stakes where predefined holes must be configured or lined up with concrete form 1310, the stake forming apparatus according to an embodiment of the instant application improves fastening concrete form 1310 to stake 1308. Additionally, stake 1308 may have prepositioned holes traversing stake 1308 along with the channels.

Furthermore, base members 1302 may be used in combination with vapor barrier 1314. As previously discussed herein, an adhesive layer may be applied to base member 1302 in order to secure base member 1302 to vapor barrier 1314.

Figure 14:
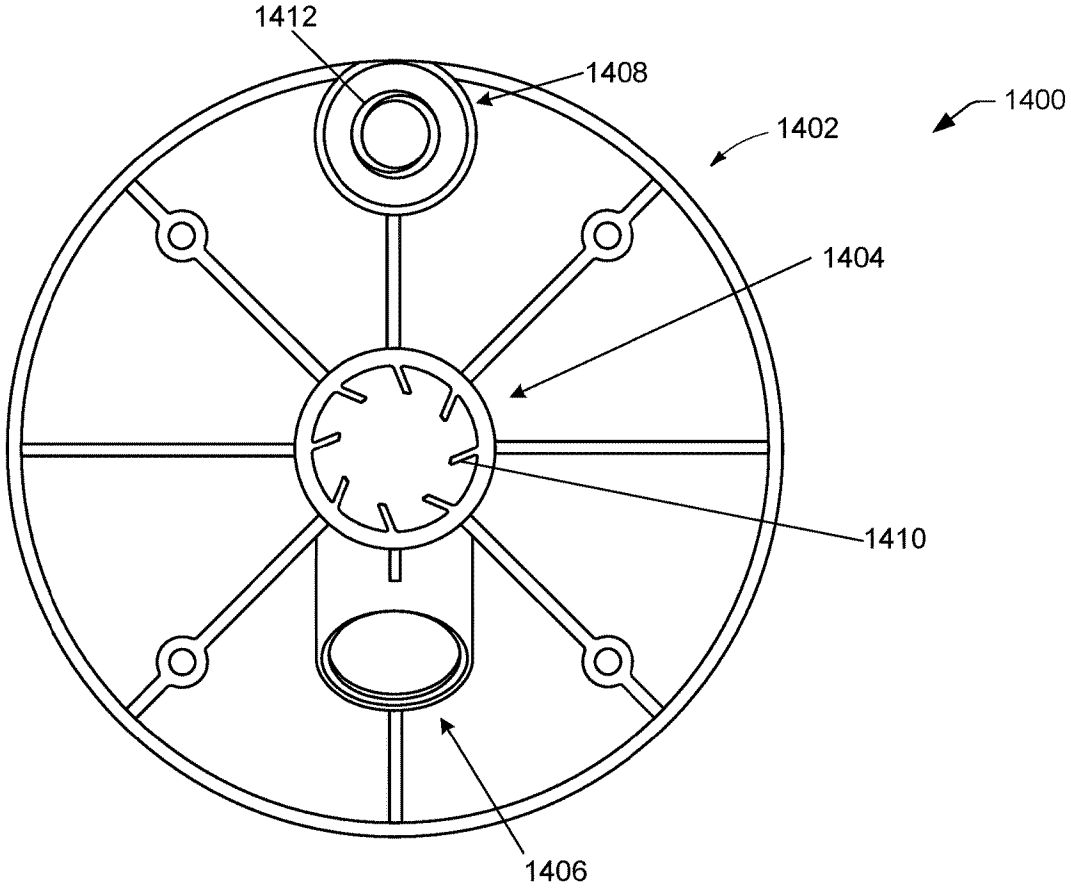
FIG. 14 illustrates a top view of a base member of the concrete forming stake apparatus according to an embodiment of the application.
Figure 15:
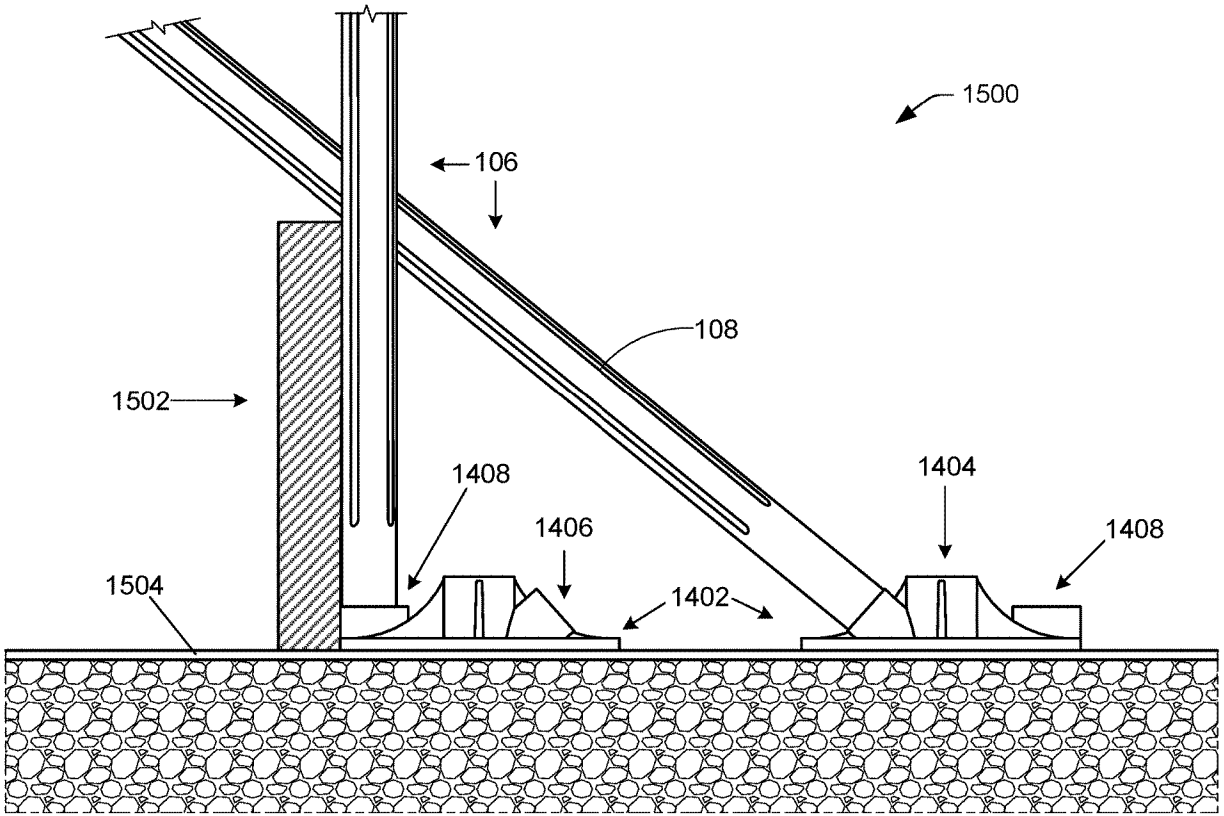
FIG. 15 illustrates a side view of the concrete forming stake apparatus of FIG. 14 according to an embodiment of the application.

FIGS. 14 and 15 illustrate an alternative embodiment of a concrete forming stake apparatus. For instance, embodiment 1400 as shown in FIG. 14, may include base member 1402 having a top mounting port 1404, a side mounting port 1406, and an edge mounting port 1408. In other aspects, base member 1402 may include similar features as those previously discussed with respect to base member 102. For instance, base member 1402 may include gussets, an adhesive layer, fastener holes, etc. Top mounting port 1404 may include a plurality of ribs 1410 to engage a stake (see FIG. 15). Ribs 1410 may be configured to snuggly fit around the outer perimeter of the stake and hold it in place by flexing in a direction away from the stake when the stake is inserted into top mounting port 1404. When the stake is engaged with top mounting port 1404, ribs 1410 may provide support to the stake and apply resistance to prevent the stake from backing out of top mounting port 1404. However, by applying force, the stake may be rotated within top mounting port 1404, or alternatively, may be extracted from top mounting port 1404.

Moreover, while ribs 1410 are shown as extending at a particular angle off an inner surface of top mounting port 1404, ribs 1410 may be implemented at any angle to engage and position the stake. Furthermore, while top mounting port 1404 is shown with ribs 1410, the stake may engage with top mounting port 1404 without the use of ribs 1410. For instance, the stake may be in contact with an inner surface or wall of top mounting port 1404, or alternatively, may be threaded into top mounting port 1404.

Side mounting port 1406 may be positioned or orientated at any location around an axis of top mounting port 1404 and may extend at a fixed angle relative to base member 1402 or top mounting port 1404 to permit the opening of side mounting port 1306 to face any outward direction to allow a stake (not shown) to be inserted therein.

Edge mounting port 1408 may be positioned near an outer perimeter of base member 1402 and extend in a vertical direction above base member 1402. In some instances, edge mounting port 1408 may have an opening that is parallel to a top surface of base member 1402. That is, when a stake (not shown) is inserted into the opening of edge mounting port 1408, the stake may extend perpendicularly to base member 1402. Alternatively, edge mounting port 1408 may be positioned at any location on a top surface on base member 1402.

Both side mounting port 1406 and edge mounting port 1408 may be configured to engage a stake (for instance, stake 106). In some instances, side mounting port 1406 and edge mounting port 1408 may engage a stake through a threaded or compression fit. For instance, edge mounting port 1408 may have a male threaded segment 1412 to engage a female threaded segment of stake 106 (1002 of FIG. 10). Moreover, while not shown, base member 1402 may incorporate more than one side mounting port 1406 or edge mounting port 1408. In addition, top mounting port 1404, side mounting port 1406, and/or edge mounting port 1408 may be of a same or similar size and with different or similar sized openings to allow various sized stakes to fit therein.

FIG. 15 illustrates an embodiment 1500 where base member 1402 of FIG. 14 is used to support and secure concrete forms. As previously mentioned, base member 1402 may have top mounting port 1404, side mounting port 1406, and edge mounting port 1408. Stake(s) 106 may be attached to base member 1402, through either all or one of top mounting port 1404, side mounting port 1406, or edge mounting port 1408. Stakes 106, as previously discussed herein, may have channels 108 that extend along a lengthwise direction of stake 106, to allow fasteners (not shown) to be fastened to concrete form 1502. Additionally, stake 106 may have prepositioned holes traversing stake 106 along with channels 108. As shown, edge mounting port 1408 allows stake 106 to be positioned along a surface of concrete form 1502 so as to provide support along a length, or height, of the concrete form 1502. That is, edge mounting port 1408 allows base member 1402 to be positioned in close proximity to concrete form 1502, while still permitting stake 106 to support concrete form 1502.

Furthermore, base members 1402 may be used in combination with vapor barrier 1504. As previously discussed herein, an adhesive layer may be applied to base member 1402 in order to secure base member 1402 to vapor barrier 1504.

Figure 16:
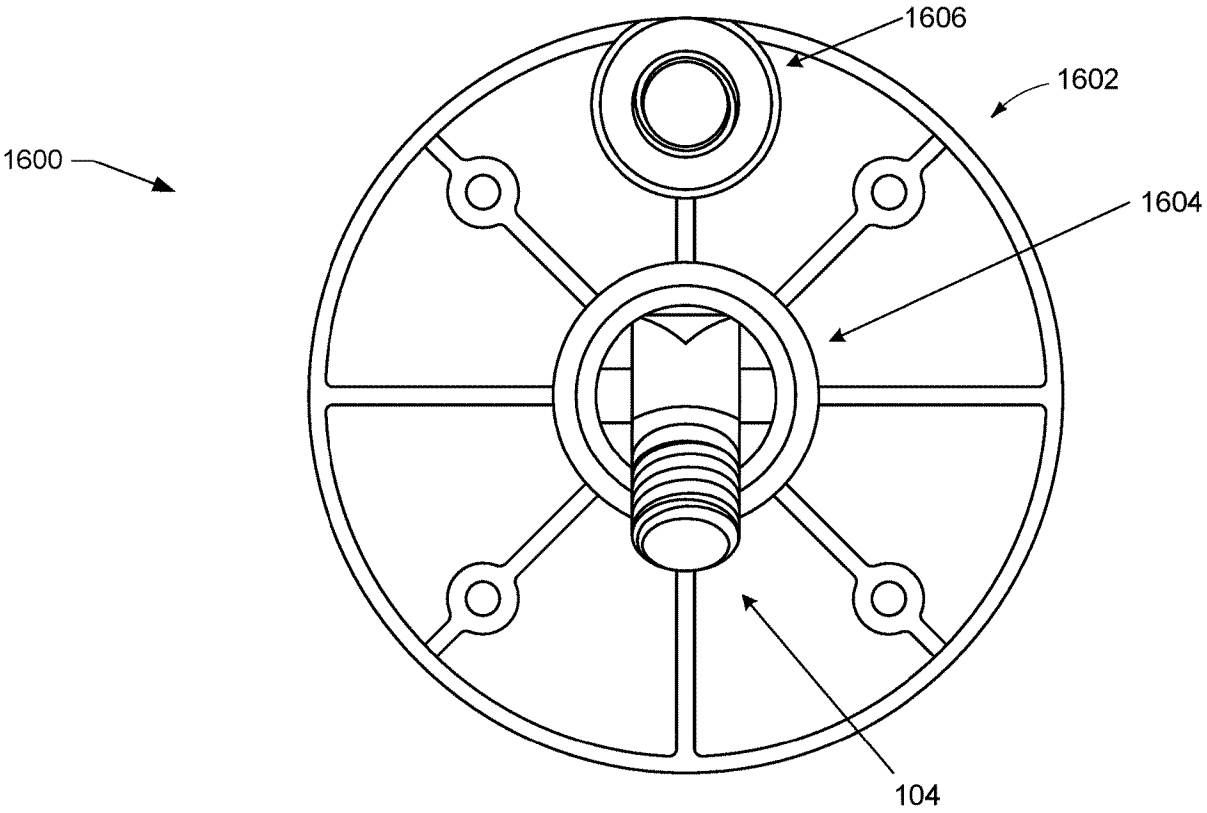
FIG. 16 illustrates a top view of a base member of the concrete forming stake apparatus according to an embodiment of the application.
Figure 17:
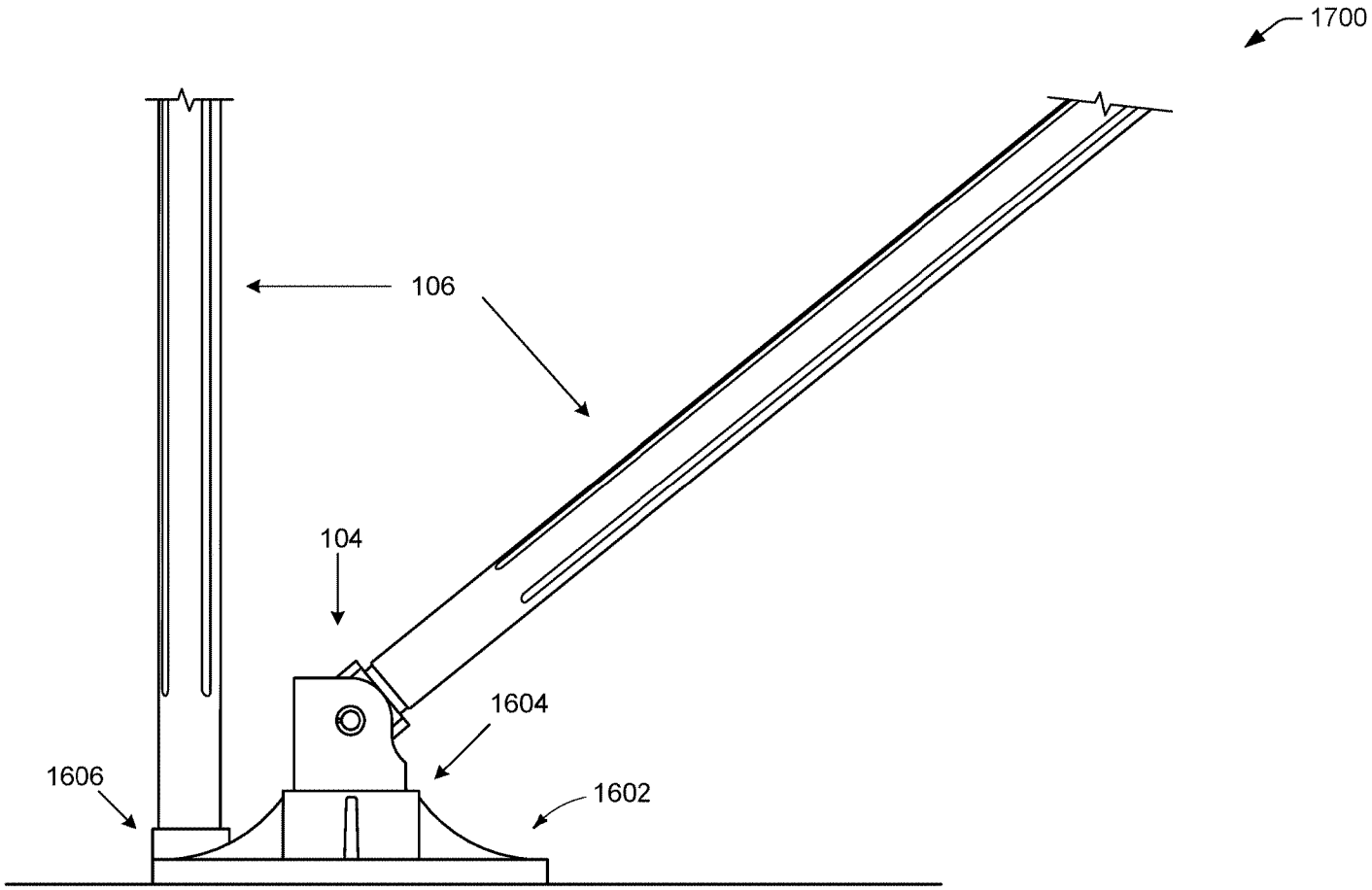
FIG. 17 illustrates a side view of the concrete forming stake apparatus of FIG. 16 according to an embodiment of the application.

FIGS. 16 and 17 illustrate an alternative embodiment of a concrete forming stake apparatus. Shown in FIG. 16 is an embodiment 1600 having base member 1602, which may have similar features as base member 1402 of FIGS. 14 and 15.

Base member 1602 may include top mounting port 1604 and edge mounting port 1606. Top mounting port 1604 may be in contact with stake attachment member 104 to engage a stake, for instance stake 106 (not shown). Thus, stake attachment member 104 may be permitted to rotate freely about an axis of base member 1602 to position a stake. That is, top mounting port 1604 may be similar to stake mounting port 504 discussed in FIG. 5. Moreover, while not shown, base member 1602 may incorporate an additional mounting port, such as side mounting port 1406 as discussed in FIGS. 13 and 14.

Referring to FIG. 17, an embodiment 1700 shows base member 1602 being used to support and position stakes 106.

While multiple stakes 106 are illustrated simultaneously, it is contemplated that base member 1602 may, of course, be used with a single stake as well.

Figure 18:
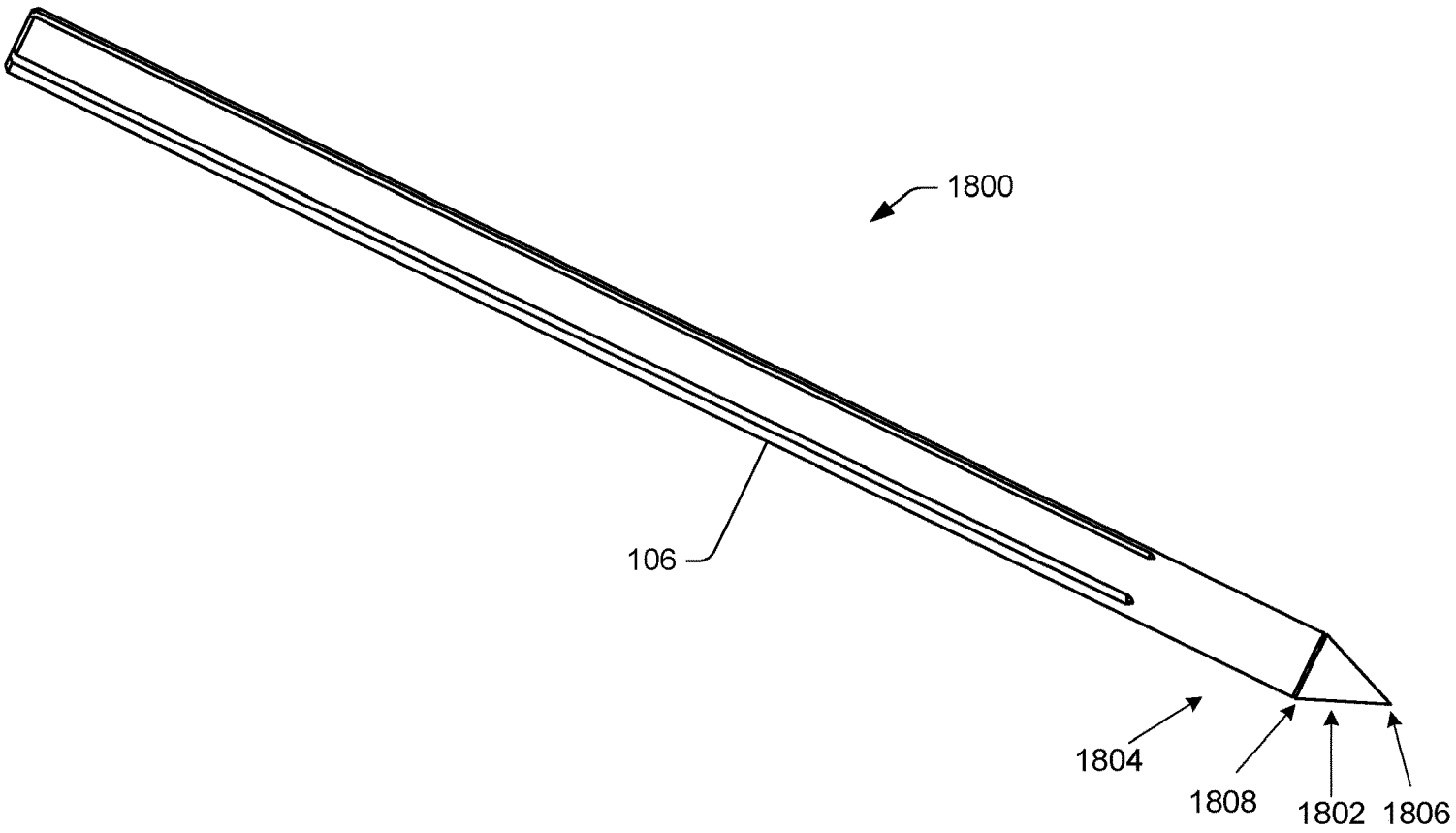
FIG. 18 illustrates a perspective view of a stake of the concrete forming stake apparatus according to an embodiment of the application.
Figure 19:
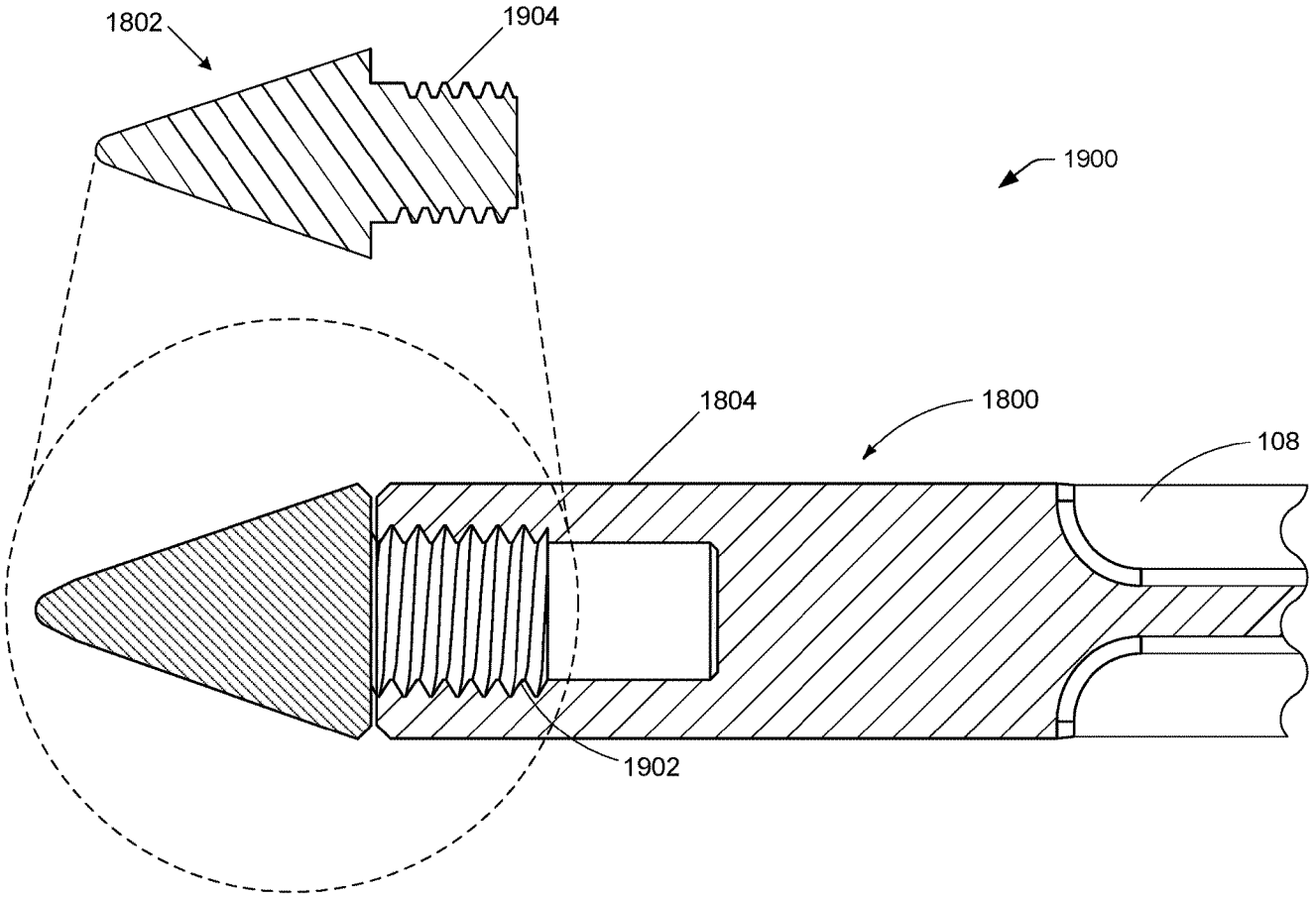
FIG. 19 illustrates a cross-sectional view of the stake in FIG. 18 according to an embodiment of the application.
Figure 20:
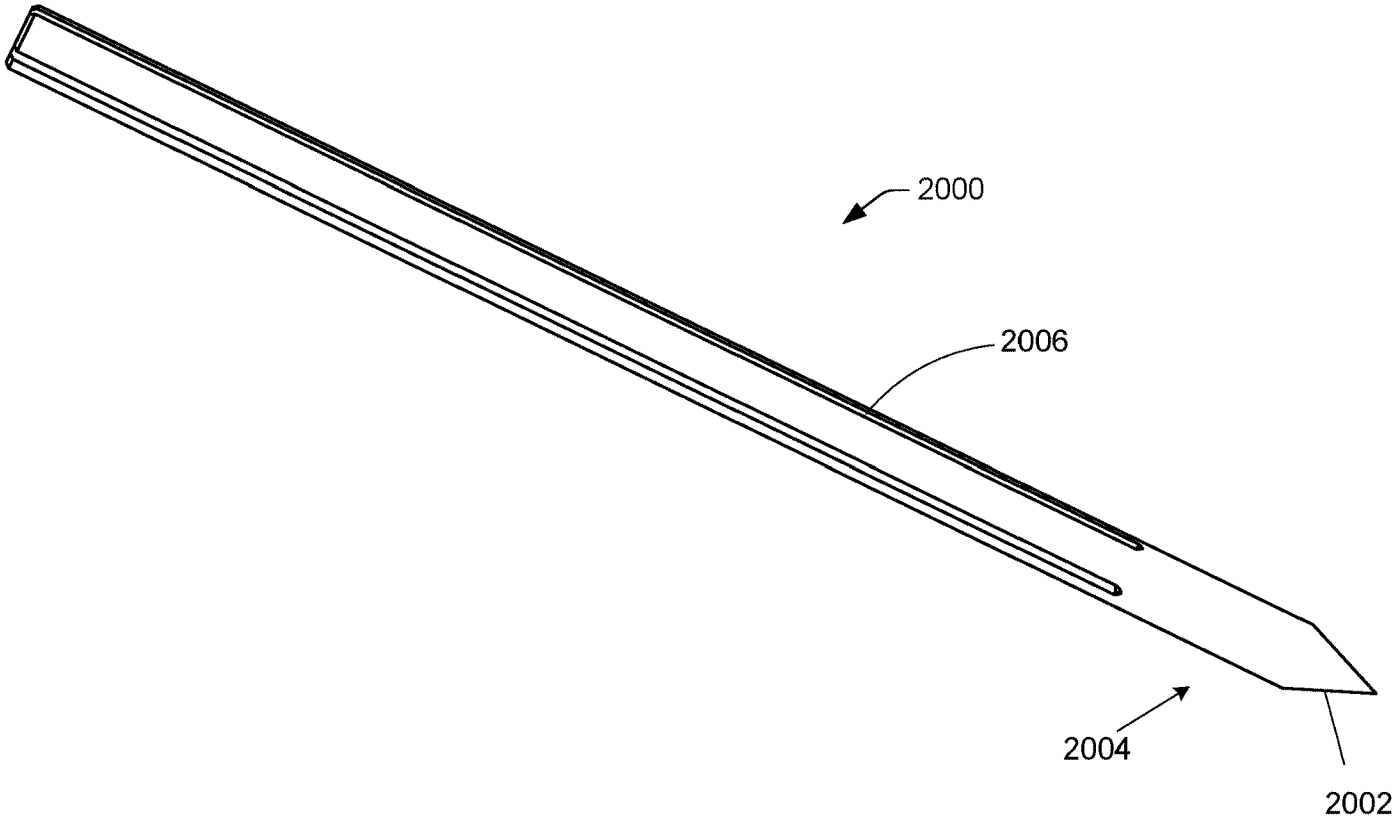
FIG. 20 illustrates a perspective view of a stake of the concrete forming stake apparatus according to an embodiment of the application.

FIGS. 18-20 illustrate a further embodiment of a concrete forming stake apparatus. Shown in FIG. 18 is an embodiment of a stake 1800 including a main body composed of a stake 106 and a spiked tip 1802 at the proximal end 1804 thereof. Tip 1802 may, for instance, be used to permit stake 1800 to be driven into a surface with ease when using stake to support and secure concrete forms. In some instances, tip 1802 may be made of a durable and rigid material such that tip 1802 may withstand repeated use. However, in other instances, tip 1802 may be made of a durable plastic from the same or similar materials discussed above with which the stake body 106 of the stake 1800 is made.

At one end of tip 1802, is a narrow, pointed end 1806 that provides stake 1800 with a sharp tip to allow stake 1800 to be driven into clay, rock, or other compacted surfaces, while the opposite, wide end 1808 may connect spiked tip 1802 to stake 1800. That is, tip 1802 may be a separate feature and attach to proximal end 1804 of stake 1800. For instance, tip 1802 may attach through a threaded joint or compression fit.

Furthermore, while a profile shape of spiked tip 1802 is shown, such profile is provided as a schematic example of the spiked tip 1802. The specific size, pointiness, and/or shape of spiked tip 1802 may vary according to factors of the intended use.

When tip 1802 is configured as a separate feature, stake 1800 may be implemented in multiple embodiments. For instance, tip 1802 may disengage, or be unscrewed, to permit stake 1800 to be attached to base member 102 via stake attachment member 104, or may be directly engaged with base member 1402 or 1602 through the aforementioned top, side, or edge ports. Alternatively, when tip 1802 is engaged or attached to stake 1800, stake 1800 may be used without a base member to support concrete forms. In both example embodiments, grooves along stake 1800 allow for the placement of fasteners through stake 1800 and into concrete forms.

FIG. 19 depicts a cross-sectional view 1900 of stake 1800 having a spiked tip 1802. Spiked tip 1802 may be inserted into a female threaded segment 1902 on proximal end 1804 of stake 1800 via male threaded segment 1904 of spiked tip 1802. However, in an alternative embodiment, proximal end 1804 of stake 106 may have a male threaded segment, while tip 1802 has a female threaded segment. In some instances, threaded segment 1904 may be made of a durable plastic, while the spiked tip 1802 or a portion thereof, may be made of a different material, such as metal. Moreover, as stake 1800 may be subjected to repetitious hammering or pounding, grooves 108 may be modified such that the radial depth is varied to prevent stake 106 from bending, twisting, and/or buckling when being placed into the surface.

FIG. 20 illustrates an embodiment showing stake 2000 having a spiked tip 2002 on the proximal end 2004 thereof. Compared to stake 1800, stake 2000 may integrate spiked tip 2002 such that stake 2000 may be fabricated and molded with a spiked tip 2002. In some instances, stake 2000 may be pounded or hammered into a surface and be used to support concrete forms via grooves 2006 that extend along a lengthwise direction of stake 2000 to permit fasteners to pass therethrough. Accordingly, grooves 2006 may allow fasteners to be easily aligned with concrete forms.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A concrete forming stake apparatus, comprising:
- a base member having a planar side and a stake mounting port disposed opposite the planar side;
- a stake attachment unit including:
  - a tubular portion that engages with the stake mounting port, and
  - a joint connected to the tubular portion;
- a stake that attaches to the joint; and
- an adhesive layer disposed against the planar side of the base member, the adhesive being configured to secure the apparatus to a surface without penetrating fasteners.

2. The concrete forming stake apparatus according to claim 1, wherein the tubular portion is concentric about an axis of the stake mounting port, and is freely rotatable about the axis up to 360 degrees.

3. The concrete forming stake apparatus according to claim 1, wherein the tubular portion is rotatable within the stake mounting port.

4. The concrete forming stake apparatus according to claim 1, wherein the stake mounting port includes a latch mechanism that engages within an internal wall of the tubular portion.

5. The concrete forming stake apparatus according to claim 1, wherein the tubular portion lockingly engages the stake mounting port.

6. The concrete forming stake apparatus according to claim 1, wherein the stake mounting port includes:
- a peripheral support wall, and
- a latch mechanism.

7. The concrete forming stake apparatus according to claim 6, wherein the tubular portion includes:
- an outer peripheral wall inserted within the peripheral support wall of the stake mounting port, and
- an internal wall connected to and coaxial with the outer wall, the stake attachment unit being secured to the base member via engagement between the latch mechanism and the internal wall.

8. The concrete forming stake apparatus according to claim 1, wherein the joint is connected to the tubular portion via a pivot joint, an axis of the pivot joint extending orthogonally to a direction of extension of the tubular portion.

9. The concrete forming stake apparatus according to claim 1, wherein the tubular portion has:
- a base end that engages with the stake mounting port,
- a stake end that extends above the stake mounting port and that has an opening opposite the base end, the joint being connected to the stake end, and
- a slot that extends down a sidewall of the tubular portion on the stake end, the joint being positioned to pivot through the slot.

10. The concrete forming stake apparatus according to claim 1, wherein the base member includes fastener holes configured to receive mechanical fasteners to secure the apparatus to a surface.

11. The concrete forming stake apparatus according to claim 1, wherein the stake threadingly engages the joint.

12. A concrete forming stake apparatus comprising:
- a base member having a planar side and a stake mounting port disposed opposite the planar side;
- a stake attachment unit including:

a tubular portion that engages with the stake mounting port, and a joint connected to the tubular portion; and a stake that attaches to the joint, the stake including at least one groove extending along at least a portion of the stake.

13. The concrete forming stake apparatus according to claim 12, wherein the stake includes a plurality of grooves extending along at least a portion of the stake.

14. The concrete forming stake apparatus according to claim 13, wherein the plurality of grooves extend in one of straight lines, zigzag lines, or helical lines.

15. The concrete forming stake apparatus according to claim 12, wherein a proximal end of the stake has a threaded hole configured to threadingly receive therein the joint.

16. The concrete forming stake apparatus according to claim 12, wherein a distal end of the stake is partitioned into two or more sections that are adjoined at least partially along a central axis of the stake.

17. The concrete forming stake apparatus according to claim 12, further comprising an adhesive layer disposed against the planar side of the base member, the adhesive being configured to secure the apparatus to a surface without penetrating fasteners.

18. A concrete forming stake apparatus, comprising:

a base member including a stake mounting port;

a stake that indirectly connects to the stake mounting port, the stake including at least one groove extending along at least a portion of the stake; and a stake attachment member accommodated within the stake mounting port to connect the stake to the stake mounting port so as to permit the stake to rotate freely up to 360 degrees.

19. The apparatus according to claim 18, wherein an end of the stake is configured to removably detach from the stake attachment member.

20. The apparatus according to claim 18, wherein the stake attaches to the stake attachment member via a ball joint, the stake including a connection member that is at least partially spherical, and wherein the stake attachment member is a collar that engages the stake mounting port, an inner surface of the collar slanting radially inward from a first diameter to a second diameter forming a conical frustum shaped surface, and the second diameter being smaller than a largest diameter of the connection member and the first diameter being larger than the second diameter.

* * * * *